US007059226B2

(12) United States Patent
Alon et al.

(10) Patent No.: US 7,059,226 B2
(45) Date of Patent: Jun. 13, 2006

(54) PAGE INDEXING SYSTEM AND APPARATUS FOR FORMING PAGE SHAPES OF SYSTEM

(75) Inventors: Edward E. Alon, 5333 Crebs Ave., Tarzana, CA (US) 91356; Bradford T. Sorensen, Manhattan Beach, CA (US)

(73) Assignee: Edward E. Alon, Los Angeles, CA (US)

( * ) Notice: Subject to any disclaimer, the term of this patent is extended or adjusted under 35 U.S.C. 154(b) by 106 days.

(21) Appl. No.: 10/251,520

(22) Filed: Sep. 20, 2002

(65) Prior Publication Data

US 2004/0056474 A1 Mar. 25, 2004

(51) Int. Cl.
*B26D 5/20* (2006.01)

(52) U.S. Cl. ..... 83/76; 83/100; 83/917; 412/16

(58) Field of Classification Search ..... 83/76, 83/100, 917, 23, 37, 112, 113, 287, 300, 734; 412/16; 270/52.17
See application file for complete search history.

(56) References Cited

U.S. PATENT DOCUMENTS

| | | | | |
|---|---|---|---|---|
| 197,345 | A | | 11/1877 | Denison |
| 447,371 | A | | 3/1891 | Silvera |
| 455,817 | A | | 7/1891 | Hewes |
| 854,069 | A | | 5/1907 | Williams |
| 1,017,915 | A | | 2/1912 | Rosenthal |
| 1,106,158 | A | | 8/1914 | Pickett |
| 1,711,895 | A | | 5/1929 | Lehman et al. |
| 1,743,305 | A | | 1/1930 | Banks |
| 1,958,537 | A | * | 5/1934 | Glass ..... 83/244 |
| 3,995,389 | A | | 12/1976 | Mathis |
| 4,072,076 | A | * | 2/1978 | Miles ..... 83/300 |
| 4,247,999 | A | | 2/1981 | Latino |
| 5,036,736 | A | * | 8/1991 | Hillock et al. ..... 83/23 |
| 5,127,677 | A | | 7/1992 | Merry |
| 5,242,197 | A | | 9/1993 | Raynak |
| 5,309,804 | A | * | 5/1994 | Norris et al. ..... 83/37 |
| 5,743,036 | A | | 4/1998 | Zumwalt |
| 5,792,535 | A | | 8/1998 | Weder |

FOREIGN PATENT DOCUMENTS

| | | |
|---|---|---|
| GB | 413243 | 7/1934 |

* cited by examiner

*Primary Examiner*—Allan N. Shoap
*Assistant Examiner*—Carolyn T. Blake
(74) *Attorney, Agent, or Firm*—Denton L. Anderson; Sheldon & Mak PC

(57) ABSTRACT

A finger-operated page turning device for stacked sheets, with methods, apparatus for forming the device as sets offset voids or notches in alternating pages of a stack. The device is operated by simple movements of the thumb and/or fingers of a user's one hand while holding the stack in a curved configuration in the user's other hand. The apparatus includes rotary cutting machines for web sheet material, as well as both computer controlled and hand punches for individual sheets.

6 Claims, 19 Drawing Sheets

FIG. 12
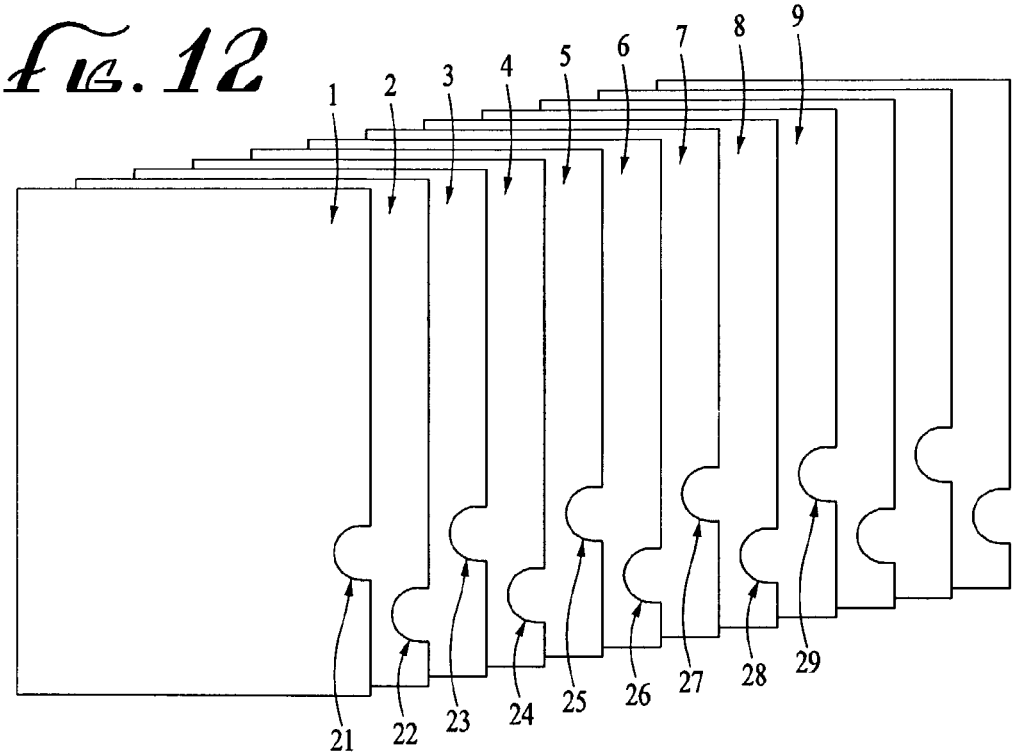
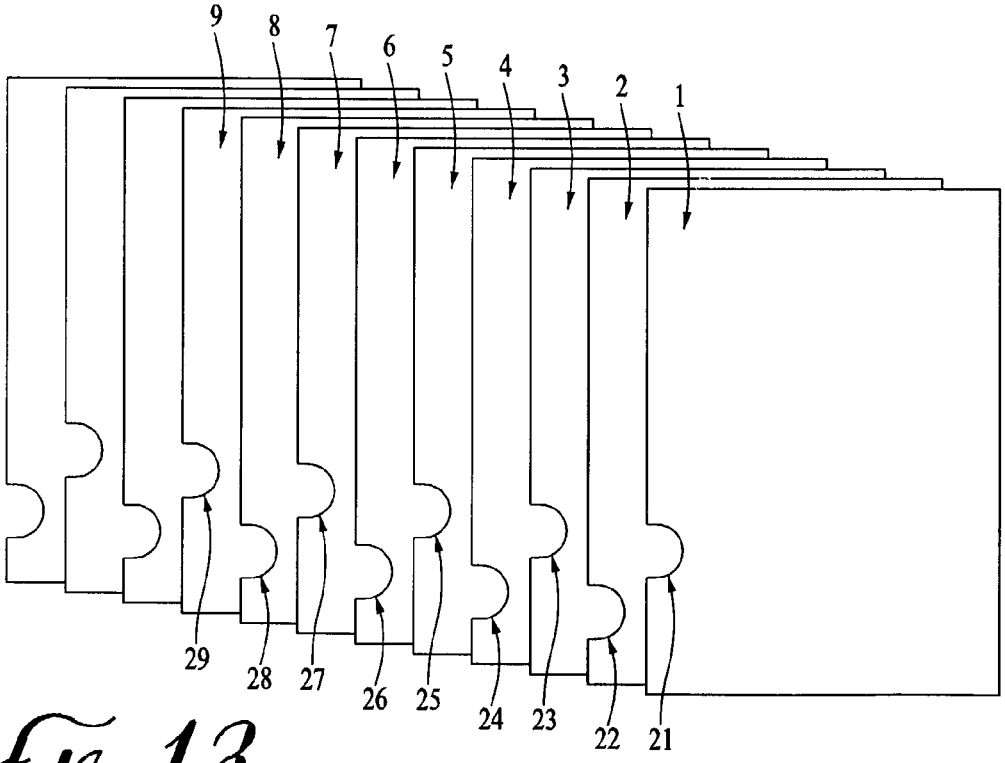
FIG. 13

PAGE INDEXING SYSTEM AND APPARATUS FOR FORMING PAGE SHAPES OF SYSTEM

BACKGROUND

The present invention relates to an innovation in the shapes of pages of documents, pages of books or other stacked paper which functions in cooperation with the thumb and/or fingers and other parts of the human hand to facilitate the ease of quickly turning pages in a stack of documents, one by one, without accidentally missing a page, and to apparatus for forming such shapes of the pages.

The process of turning pages in a stack of documents while reading typically involves several common methods. One method is to thumb through the pages by grasping the stack of pages with the human hand with the fingers under the stack pressing the underside of the stack upwardly causing the edge of the stack to come in contact with the thumb causing a fanning out of the pages for quick scanning and reading. While this method is good for quick scanning, some pages may stick together or simply move as a group causing the reader to accidentally miss seeing some of the pages of the document. Another method of turning pages involves pealing back the edge of the top sheet of paper from the stack, sliding the hand under and turning the page by moving the hand across the pages in the stack. Since stacks of paper contain sheets of generally thin and uniform size paper, it is possible to accidentally peal back more than one sheet of paper from the stack and turn it by moving the hand across the pages in the stack, causing the reader to accidentally miss seeing one or more of the pages of the document. Another method of turning pages involves the wetting of the thumb or fingers to provide adhesion to the top page of a stack of documents. The increased friction of adhesion caused by wetting the fingers or thumb allows the movement of a single sheet for turning by moving the hand across the pages in the stack, but this method also allows for the accidental movement of more than one sheet of paper at a time, causing the reader to accidentally miss seeing some of the pages of the document. Also, wetting the fingers which come in contact with the page with saliva causes discoloration, smearing, contamination and deformation of the paper documents, especially if the fingers are dirty.

Apparatus for reconfiguring page sheets are known. For example, U.S. Pat. No. 4,220,323 to Smith discloses a sheet receiving and stacking apparatus for alternating the sheets of a stack in a face up, face down, face up . . . manner. Also, U.S. Pat. No. 3,928,268 to Gilhula discloses a system of pressure sensitive adhesive strips added to the edge of the paper to form index tabs. However, none of the apparatus of the prior art is believed to provide the features and advantages of the present invention. In particular, the system of Gilhula is believed to be excessively expensive to operate in that the adhesive strips would be more costly than the sheets to which they are applied, being impractical for application on every sheet of a stack for this reason as well as for excessive bulkiness of the stack.

Thus there is a need for a system facilitating sequential and/or selective viewing of stacked sheets, and a way to alter sheets of a stack to facilitate the viewing of the sheets, that is easy to use, and inexpensive to provide.

SUMMARY

The present invention meets this need by providing an indexing device wherein voids or notches that are formed at alternating locations in successive flexible sheets, producing an innovative shape of the paper which takes into account the functions of the thumb and/or fingers and other parts of the human hand to provide a new method of turning pages in a stack of documents quickly, one by one, without accidentally missing a page, without wetting a page and without moving the hand across the stack of documents (which would temporarily obscure view of successive pages on the stack). The invention also provides apparatus for producing the innovative shape of the paper. In one aspect of the invention, a hand operated sheet turning device includes a stack of sheets of flexible material having a void or notch shape extending inwardly from the edge of each sheet, the void or notch shapes alternating in position with each successive sheet in the stack, wherein the alternating positions are spaced apart by a distance of between approximately 2 inches and approximately 4 inches for engagement at a corresponding spacing between a user's thumb and finger. The alternating alignment can be of respective first and second sets of the voids or notches, at least one of the first and second sets being preferably formed with an outwardly beveled portion extending to the edge of the sheet opposite the other of the first and second sets for facilitating clearance with the user's thumb.

The void/s or notch/s can be cut into the edge of a standard size of paper selected from the set consisting of executive, letter, legal, tabloid, A, A4, B, C, D, E and memo size paper. The void/s or notch/s can be cut into the edge of paper selected from the set consisting of copy paper, color copy paper, printer paper, printed paper, laser paper, colored laser paper, ink jet paper, colored ink jet paper, premium color ink jet paper, photo ink jet paper, specialty ink jet paper, fax paper, multipurpose paper, colored paper, computer paper, stationery, business forms, loose leaf filler paper, paper rolls, design paper, specialty paper, presentation paper, colored card stock, fine business paper, card stock, poster stock, construction paper, drawing paper, watercolor paper, satin design paper, tracing paper, newsprint, columnar paper, perforated paper, hole punched paper, silk paper, rag paper, carbon paper, napkins, rice paper and art paper. The sheets of flexible material can include photograph paper, proof sheets, transparency film, transparency protectors/sleeves, laminated sheets, sheet protectors, sheet sleeves, photographs, or a ledger.

The sheets of flexible material can be bound together along one edge thereof, and the void or notch shapes are preferably located in spaced relation to the bound edge for free movement of sheet portions containing the void or notch shapes. The sheets of flexible material can be located in a multiple ring binder as one or more of pages, dividers, pockets and pouches. The sheets of flexible material can be releasably held together by a self-stick substance. The sheets in the stack additionally can have alternating void or notch shapes formed for each chapter or alphabetical letter or section or division of the stack of sheets.

The alternating void or notch shapes preferably have respective first and second contours, the void or notch shapes of the first contour being aligned and the void or notch shapes of the second contour being aligned in offset relation to those of the first contour for facilitating tactile discrimination between even and odd sheets of the device. The first contour can include a generally semicircular arc and the second contour can include a generally arcuate portion and a generally angled enlargement portion extending away from the alignment of the first contour for facilitating passage of the user's thumb.

In another aspect of the invention, an indexing system includes removal of material from each sheet of stacked material to create a void or notch cut inward from the edge of each sheet of the stacked material with alternating alignment on each successive sheet of stacked material to form an indexing system which allows quick one by one separation or turning of each sheet without missing a sheet, wherein the alternating alignment is at a spacing of between approximately 2 inches and approximately 4 inches for engagement at a corresponding spacing between a user's thumb and finger. The alternating alignment can be of respective first and second sets of the voids or notches, at least one of the first and second sets being preferably formed with the outwardly beveled portion for facilitating clearance with the user's thumb.

In a further aspect of the invention, a method for turning the pages of a stack of pages without missing a page, includes:

(a) providing the stack with material removed from each page of the stack to create a void or notch extending inwardly from the edge of each page with alternating alignment of the voids or notches on odd and even pages, wherein the alternating alignment is at a spacing of between approximately 2 inches and approximately 4 inches;

(b) placing a thumb in the void or notch of one of an odd page and an even of the stack and against the next page;

(c) turning the one page while holding the thumb or finger against the next page;

(d) placing a finger in the void or notch of the next page of the stack and against a succeeding page;

(e) turning the next page while holding the finger against the succeeding page;

(f) keeping the thumb in proximate alignment with void or notch alignment of one of the odd and even pages;

(g) keeping the finger in proximate alignment with the void or notch alignment of the other of the odd and even pages; and (h) alternatively releasing the thumb and the finger from respective next pages, thereby sequentially turning at least some of the pages of the stack without missing a page.

The method can further include using the thumb or finger in the void or notch to depress the next page through the void or notch; and hooking and/or lifting an edge portion of the void or notch. The turning can include holding the stack of pages in a curved condition for urging page turning.

In yet a further aspect of the invention, an apparatus for forming the hand operated sheet turning device includes a feeder mechanism for moving sheet material in a feed path; notch die mechanism including a die cutter and a die anvil, and means for periodically advancing the die cutter into engagement with the die anvil from opposite sides of the paper path; index means for registering a leading edge of the sheet material at alternating offset distances ahead of the notch die mechanism prior to successive operations of the notch die mechanism, whereby successive sheets are formed with alternating alignment of the voids or notches therein.

The feeder mechanism can include first and second synchronized and counter-rotating drums on opposite sides of the feed path; the notch die mechanism can further include the die cutter being a first die cutter mounted on the first drum and the die anvil being a first die anvil being mounted on the second drum in registration for engagement by the first die cutter in successive rotations of the drums, a counterpart second die cutter being mounted on the first drum in circumferentially spaced relation to the first die cutter, and a counterpart second die anvil being mounted on the second drum in registration for engagement by the second die cutter; and the index means can include first and second cutter blades mounted transversely on the first drum in respective different circumferentially advanced relations to the first and second die cutters, and respective first and second cutter anvils mounted transversely on the second drum in registration for engagement by the first and second cutter blades in the successive rotations of the drums, whereby the cutter blades form leading edges of successive pairs of sheets from the sheet material and the die cutters form the voids or notches with alternating alignment in respective sheets of each pair in the successive rotations of the drums. The notch die mechanism can further include counterparts of the first and second die cutters mounted in axially spaced relation on the first drum, and counterparts of the first and second die anvils being correspondingly mounted in axially spaced relation on the second drum for forming counterpart voids or notches along opposite side edges of the sheet material; the apparatus further including a means for longitudinally folding formed sheets to form nested pairs of pages. The feeder mechanism can include first and second paper trays at opposite sides of the feed path, the first paper tray being adapted for receiving the sheet material in the form of stacked sheets, the second paper tray being adapted for sequentially receiving sheets from the feed path; and means synchronized with the notch die mechanism for sequentially advancing a top sheet from the first paper tray into the feed path; and the index means can include a stop mechanism coupled to the notch die mechanism for periodically blocking leading edges of alternating sheets at different distances beyond the die cutter and die anvil of the notch die mechanism.

The means for advancing of the feeder mechanism can include a suction cup mounted for reciprocal movement relative to the first paper tray between a first position proximate a top stacked sheet and a second position laterally displaced from the first paper tray and aligned with the feed path, in synchronism with the notch die mechanism; and a source of intermittent vacuum synchronized with the notch die mechanism and fluid coupled to the suction cup, the vacuum being applied in the first position of the suction cup and released in the second position of the suction cup. The feeder mechanism can include first and second paper trays at opposite extremities of the feed path, the first paper tray being adapted for receiving the sheet material in the form of stacked sheets, the second paper tray being adapted for sequentially receiving sheets from the feed path; and means for sequentially advancing a top sheet from the first paper tray into the feed path; and the index means can include a control mechanism for positioning and holding successive sheets in the feed path with leading edges thereof at different predetermined distances beyond the die cutter and die anvil of the notch die mechanism prior to successive operations thereof. The feeder mechanism can include first and second synchronized and counter-rotating drums on opposite sides of the feed path; the notch die mechanism can further include the die cutter being a first die cutter mounted on the first drum and the die anvil being a first die anvil being mounted on the second drum in registration for engagement by the first die cutter in successive rotations of the drums, a counterpart second die cutter being mounted on the first drum in circumferentially spaced relation to the first die cutter, and a counterpart second die anvil being mounted on the second drum in registration for engagement by the second die cutter; and the index means can include first and second cutter blades mounted transversely on the first drum in respective different circumferentially advanced relations to the first and second die cutters, and respective first and second cutter anvils mounted transversely on the second drum in registration for engagement by the first and second cutter blades in the successive rotations of the drums, whereby the cutter blades form leading edges of successive pairs of sheets from the sheet material and the die cutters form the voids or notches with alternating alignment in respective sheets of each pair in the successive rotations of the drums. The die cutter and anvil can be a first die cutter and anvil for producing the first contour of the void or notch shapes, the apparatus preferably also including a second die cutter and anvil for producing the second, different contour of the void or notch shapes for facilitating the tactile discrimination between even and odd sheets of the device. The first contour can include the semicircular arc and the second contour can include the generally arcuate and angled portions for facilitating passage of the user's thumb.

In yet a further aspect of the invention, a tool for forming the hand operated sheet turning device includes a hand-operated punch and die for forming respective ones of the void or notch shapes; and a stop mechanism for locating leading edges of alternating sheets at respective different distances beyond the void or notch shapes formed by the punch and die. The stop mechanism can include first and second stop members for locating leading edges of alternating sheets at respective different distances beyond the punch and die. The first and second stop members can be movably mounted on a scale member having indicia thereon for showing respective distances between the stop members and the punch and die. The punch and die can be a first punch and die unit, the device further including a second hand operated punch and die unit laterally spaced from the first punch and die, the stop mechanism comprising a stop member located at a first distance from the first punch and die and at a second distance from the second punch and die, the difference between the first and second distances being the lateral spacing between the first and second punches and dies. The stop member can be movably mounted relative to the first and second punch and die units on a scale member having indicia thereon for showing a relative distance between the stop member and the punch and die units. The punch and die units can also be formed for producing the first and second contours of the void or notch shapes for facilitating tactile discrimination between even and odd sheets of the device. The first contour can include the generally semicircular arc and the second contour can include the generally arcuate and angled enlargement portions for facilitating passage of the user's thumb.

In yet another aspect, the invention provides a process for converting respective sets of sheets having voids or notches formed inwardly from each page into a device for one by one separation or turning of each sheet without missing a sheet, the sheets of each set having the notches or voids in matching configurations and offset from the notches or voids of the sheets not included in the same set. The process includes (a) providing a first supply of sheets of a first set of the sheets; (b) providing a second supply of sheets of a second set of the sheets; (c) advancing an nth sheet from the first supply in a feed path; (d) advancing an nth+1 sheet from the second supply into stacked relation to one surface of the nth sheet; (e) advancing an nth+2 sheet from the first supply into stacked relation to the nth+1 sheet opposite the nth sheet; and (f) repeating (d) and (e) with n incremented by two in each instance for completing the device as a stack of sheets having the void or notch shapes alternating in position with each successive sheet in the stack. The first and second supplies of sheets can include respective first and second stacks of sheets, the advancing of the nth and nth+2 sheets including moving the sheets from one end of the first stack, and the advancing of the nth+1 sheet can include moving the sheets from an opposite end of the second stack.

DRAWINGS

These and other features, aspects, and advantages of the present invention will become better understood with reference to the following description, appended claims, and accompanying drawings, where:

FIG. 12 is a plan view as in FIG. 8, showing an alternative arrangement of the voids or notches;

FIG. 13 is a plan view as in FIG. 12, showing the voids or notches formed on different edges of the sheets;

FIG. 16 is a plan view of sheets of material in a stack fanned out to reveal alternating void or notch shapes formed on plural edges of each sheet;

DESCRIPTION

Figure 1:
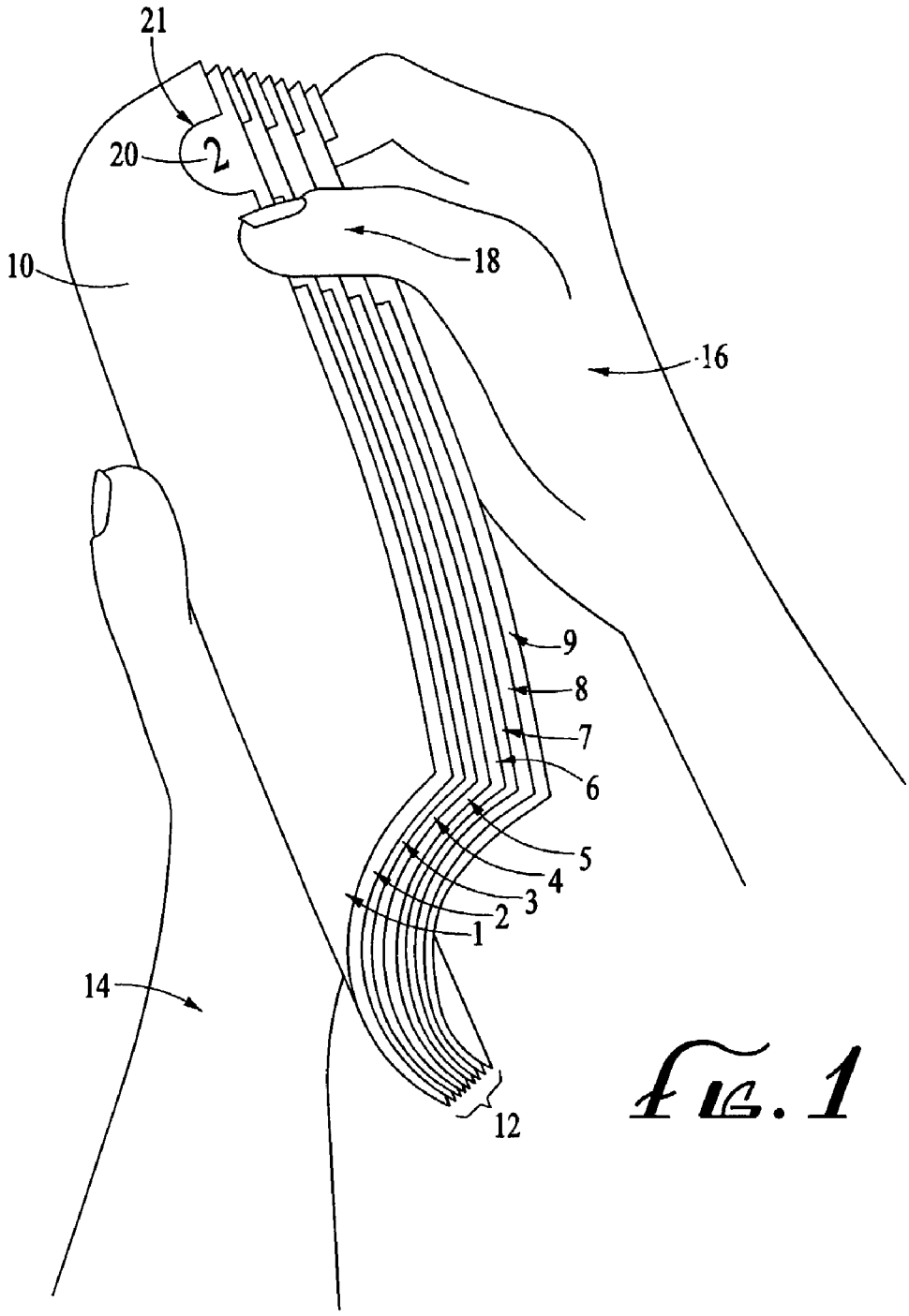
FIG. 1 is a perspective view of a stack of documents in the hands of a reader showing an improvement in the shape of the paper.

The present invention is directed to an indexing system or device for viewing successive flexible sheets of a stack using an innovative shape of the paper which takes into account the functions of the thumb and/or fingers and other parts of the human hand in a new method of turning pages in a stack of documents quickly, one by one, without accidentally missing a page, without wetting a page and without having to move the hand across the stack of documents; and to apparatus for high speed modification of the sheets to provide the innovative shapes. With reference to FIGS. 1–16 of the drawings, a sheet turning device 10 facilitating a new method of turning pages utilizes an improvement of the typically rectangular or square sheets of paper that make up stacks of paper or documents. The improvement relates to a change in the shape of the rectangular or square sheets that allows for the finger and/or thumb and the other parts of the human hand to function together to turn the pages as described herein.

One preferred embodiment of the method uses a generally rectangular or square sheet of paper with the formation of a void or notch 21 cut into the edge of the generally rectangular or square sheet of paper. This sheet with a void or notch would be the top sheet 1 of a stack of like sheets. The next sheet 2 of like paper under the top sheet would have a void or notch 22 positioned out of alignment with the void or notch 21 in the top sheet. Subsequent sheets in the stack would be numbered 3, 4, 5, 6 . . . up to the total number of sheets in the stack. The void or notch 21 in sheet number 1 would align with the void or notch in all sheets in the stack having odd numbers such as 1, 3, 5, 7 . . . . The void or notch 22 in sheet number 2 would align with the void or notch in all the sheets in the stack having even numbers such as 2, 4, 6, 8 . . . . Placing the thumb or finger in the void or notch of sheet 1 of the stack of sheets would make it possible to turn sheet 1 while keeping a thumb of finger on sheet 2, thereby stopping sheet 2 from being turned with sheet 1. When sheet 1 is turned, the void or notch on sheet 2 is exposed. A finger or thumb is placed in the void or notch in sheet 2 allowing sheet 2 to be turned while leaving a finger or thumb on sheet 3 so it cannot be turned with sheet 2. By alternating the placement of finger and/or thumb on the void or notch of each sheet of odd, then even, then odd, then even, then odd, then even, pages can be quickly turned with complete control of each page without missing any pages in the stack.

Figure 2:
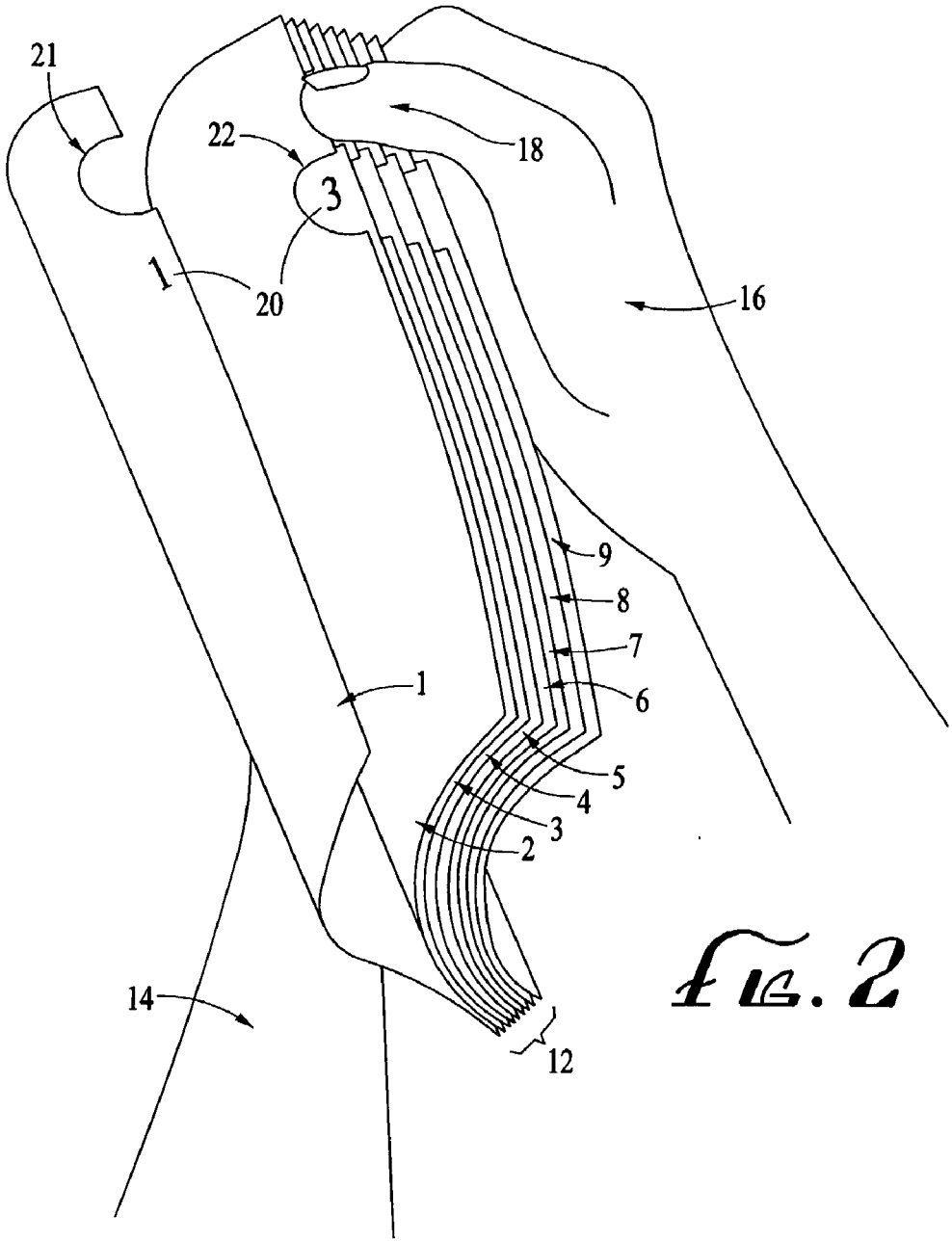
FIG. 2 is a perspective view of the document stack of FIG. 1 showing the movement of finger or thumb into a void or notch provided in the top sheet of paper which allows the top sheet of paper to move away from the stack.
Figure 3:
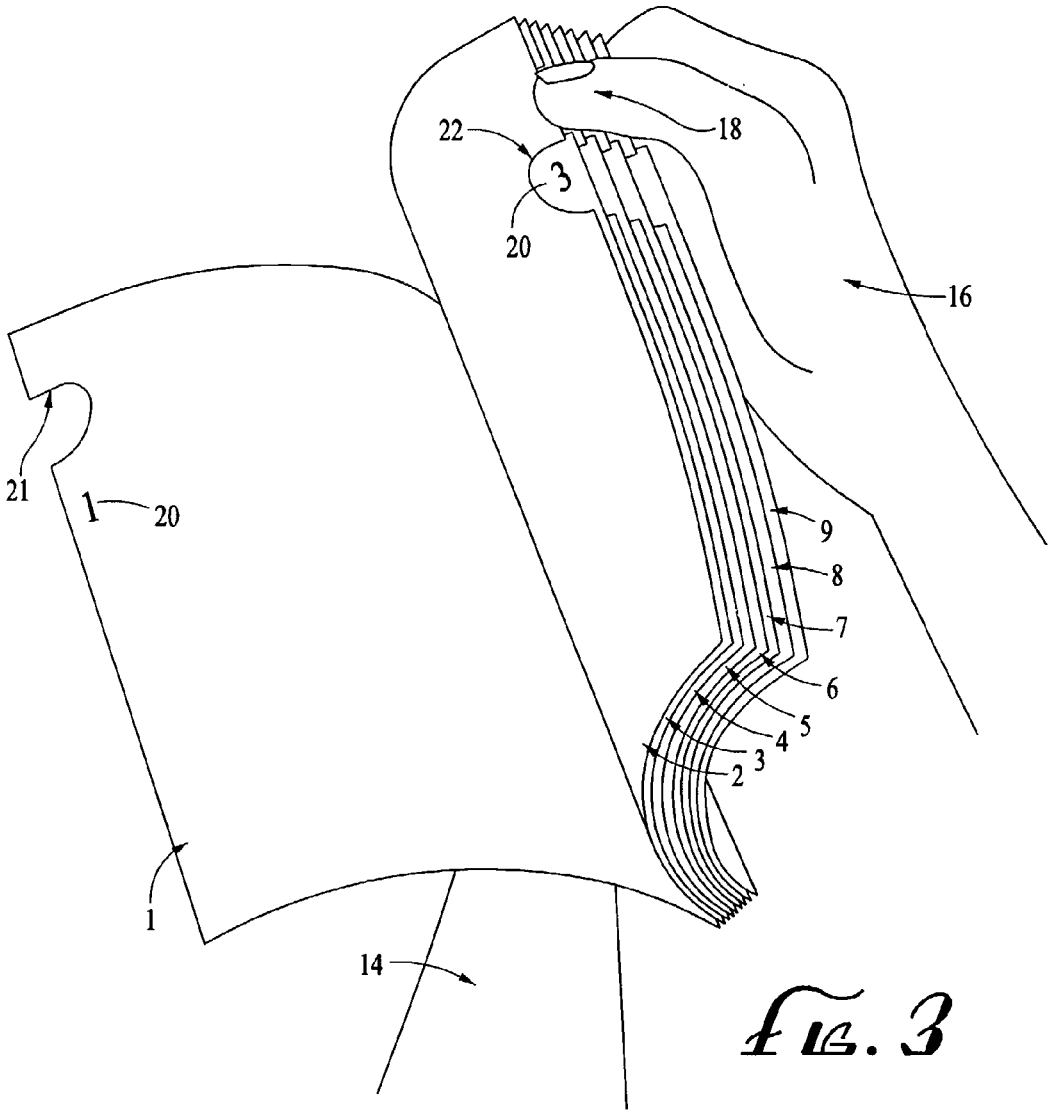
FIG. 3 is a perspective view of the document stack of FIG. 1 showing the top sheet of paper moved away from the stack.
Figure 4:
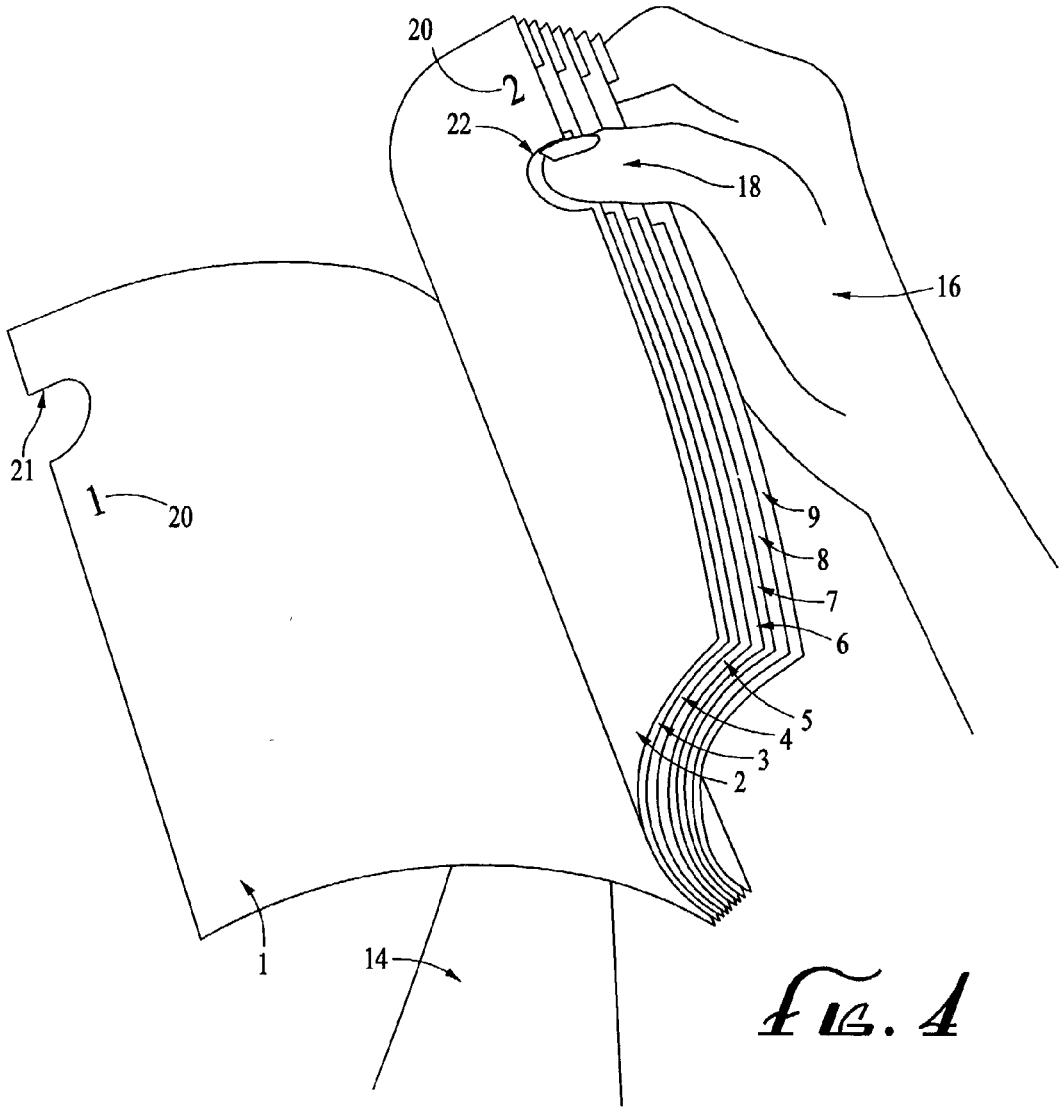
FIG. 4 is a perspective view of the document stack of FIG. 1 showing the movement of finger or thumb into a non-aligned void or notch in the second sheet of paper which allows the second sheet of paper to move away from the stack.
Figure 5:
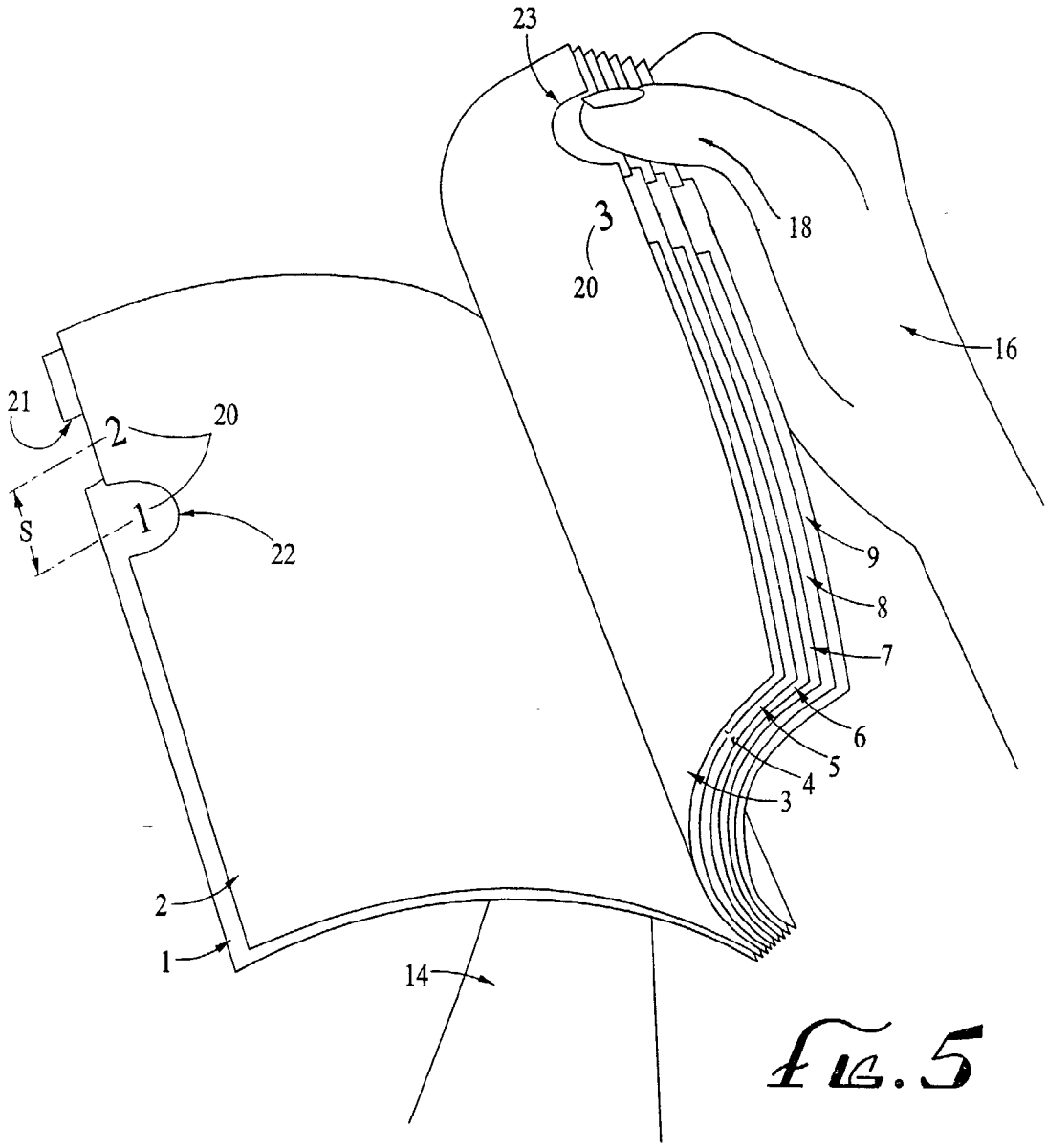
FIG. 5 is a perspective view of the document stack of FIG. 1 showing the movement of finger or thumb into a non-aligned void or notch in the third sheet of paper which allows the third sheet of paper to move away from the stack.

For example, FIG. 1 shows the device 10 with a spine portion 12 thereof supported by a user's left hand 14, the user's right hand 16 holding the sheets deflected in a curved configuration with a digit such as the thumb 18 of the right hand restraining the pages from turning, the void or notch 21 exposing a page numeral 20 (a printed "2") on sheet 2, corresponding numerals 20 being preferably similarly printed on successive sheets as further described below. More particularly, the thumb 18 is displaced from the void or notch 21 of sheet 1, preventing sheet 1 from turning. FIG. 2 shows the thumb 18 moved to a position against sheet 2 formerly occupied by the void or notch 21 of sheet 1 (exposing the page numeral 20 of sheet 1), sheet 1 being released and turning as a result of the notch 21 passing the thumb 18, sheet 2 being stopped from turning by the thumb 18, with the page numeral 20 of sheet 3 being exposed within the notch 22 of sheet 2. FIG. 3 shows sheet 1 turned or moved away from the stack, exposing facing portions of sheets 1 and 2 for reading without requiring the hand 16 to move across the pages being exposed while turning a page. FIG. 4 shows the thumb 18 moving into the notch 22 of sheet 2, releasing and allowing turning of sheet 2. Thus facing portions of sheets 2 and 3 are exposed for reading, again without requiring the hand 16 to move across the pages being exposed. FIG. 5 shows the thumb 18 moving into the void or notch 23 of sheet 3, releasing sheet 3 to turn or move away from the stack, other subsequent pages being turned in sequence by a continuation of this process. Preferably the voids or notches of the odd sheets are aligned, in displaced relation to those of the even sheets, being likewise aligned.

Figure 6:
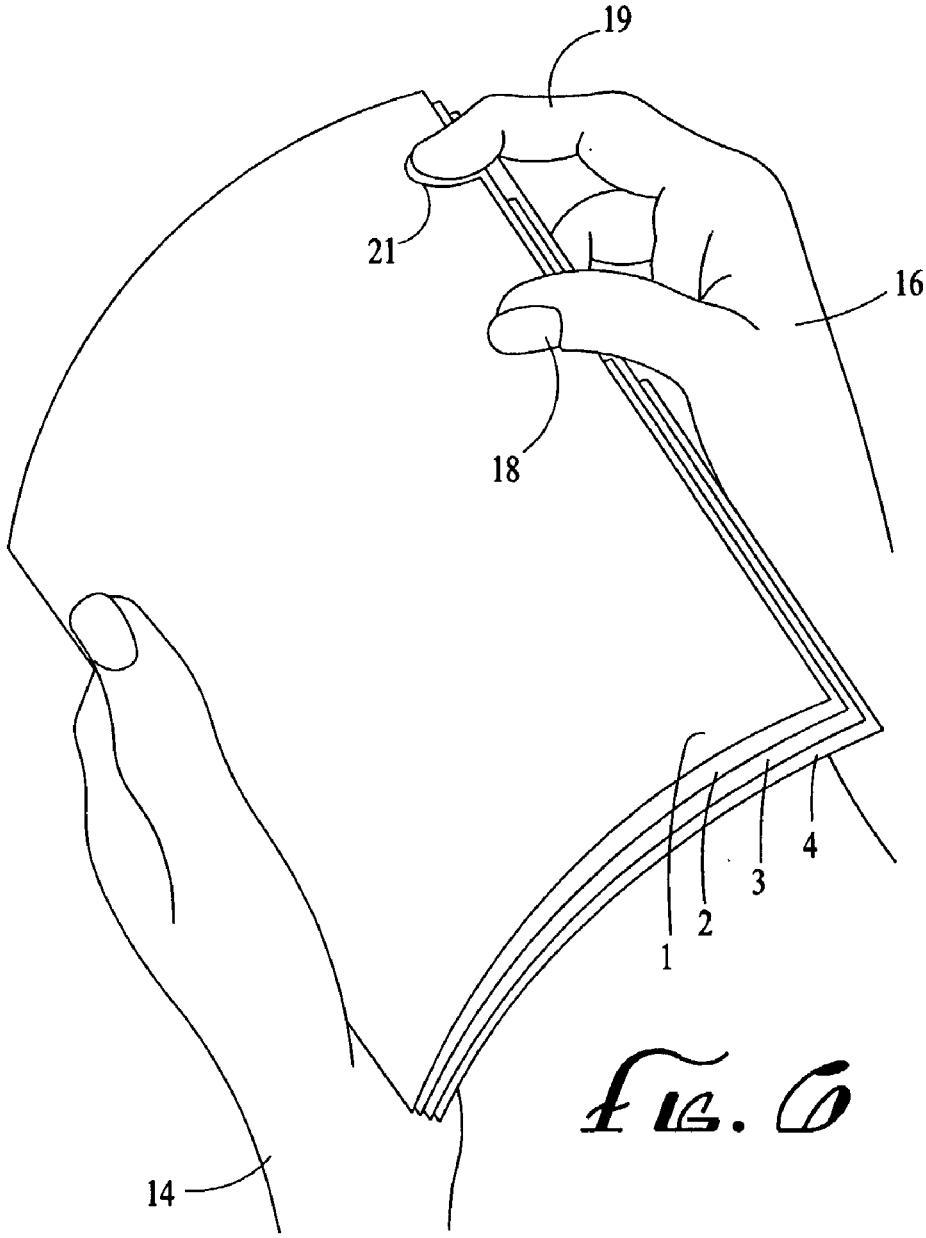
FIG. 6 is a perspective view as in FIG. 1, showing the user's thumb and index finger positioned at respective notch locations of successive sheets, the index finger being in the void or notch of the top sheet of paper.
Figure 7:
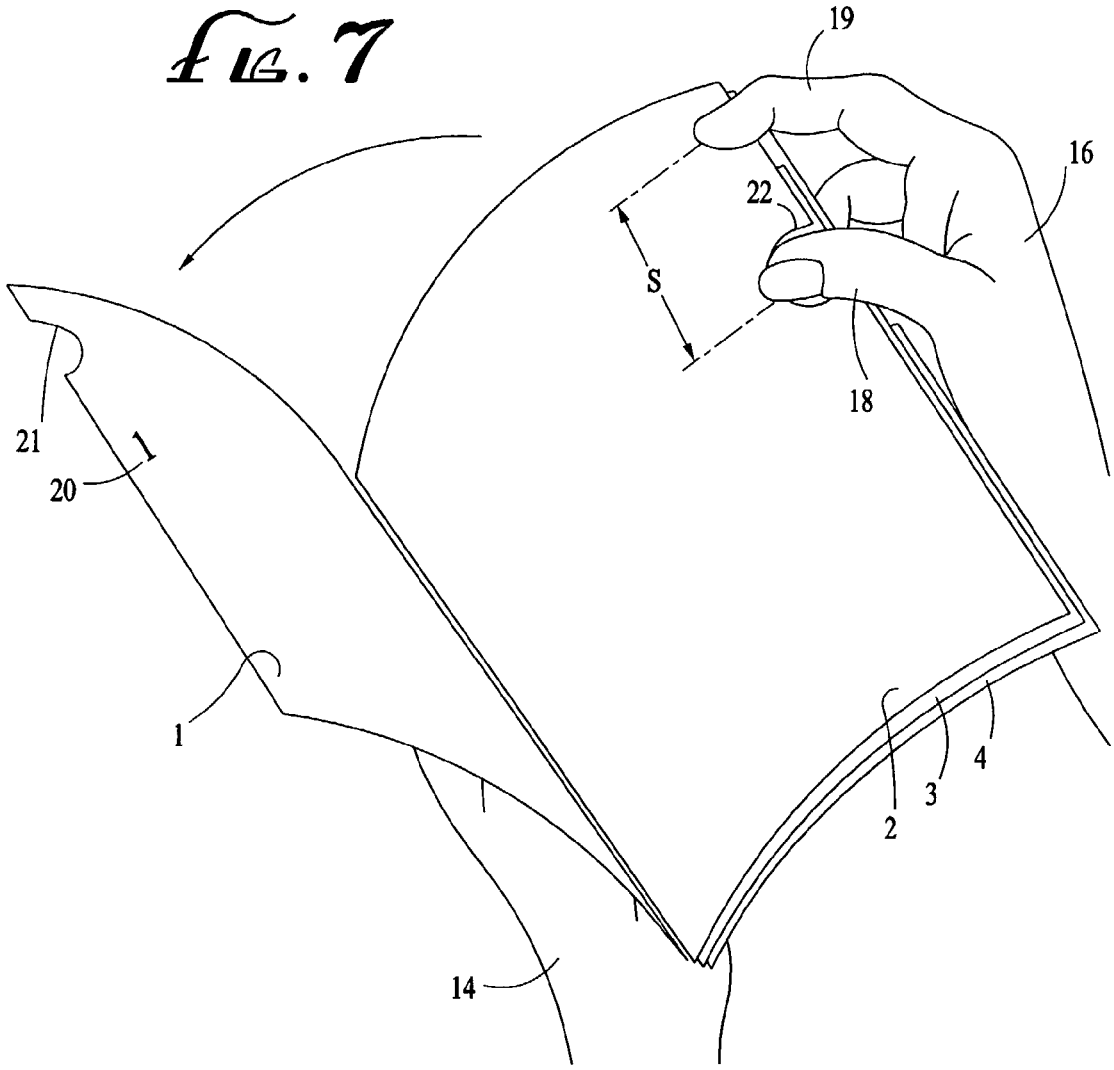
FIG. 7 is a perspective view as in FIG. 2, showing the top sheet having been released by temporary retraction of the user's thumb, the thumb having been returned to within the notch location of the second sheet as the second sheet is restrained by the index finger remaining at the location previously occupied by the notch of the top sheet.

FIGS. 6 and 7 show a particularly advantageous method for sequentially turning the pages of the device 10 being configured with the voids or notches of the odd pages being uniformly displaced from those of the even pages by a distance S being a spacing between the thumb 18 and a finger 19 of the user's hand 16.

Appropriate marks such as the page numerals 20, but not limited to page numbers and/or chapter numbers, are preferably applied to pages so as to be visible through the void or notch shape cuts. Also, in order to avoid difficulty locating the void or notch shape cut on the edge of a sheet, suitable means for differentiating the void or notch shape at the edge of the sheet by a visual and/or tactile identification of the shape. Thus a visual mark can be placed near and/or on the edge of each sheet which alternates position, color, and/or shape with each successive sheet in a stack of sheets making the void or notch more readily visible. The marks serve as guides for where to press and flip, enabling easier and quicker visual and/or tactile identification of the appropriate void or notch for sheet turning.

If a page is removed from the stack, regardless of whether an odd or even numbered sheet, the pattern of alternating void or notch locations would be interrupted and the voids or notches of the double odd or double even sheets would line up causing a condition where the two double odd or double even sheets could move together causing some information on the second sheet of the double odd or double even to be missed. The present invention also contemplates partially or completely covering the void or notch in the second sheet of the double odd or double even sheets, thereby causing the first and second sheets of the double odd or double even sheets to be separated for viewing each sheet without missing a sheet.

Referring to the drawings in greater detail, there is shown in FIG. 1 a unique shape of the paper which functions in cooperation with the thumb and/or fingers and the other parts of the human hand to provide a one by one page turning action without missing a page. FIG. 2 shows the movement or turning of the top sheet of the stack which exposes the second sheet of the stack. The location of the finger or thumb in the void or notch created by the improvement to the shape of the sheet allows the movement or turning of the top sheet but stops the movement or turning of the second sheet in the stack. FIG. 3 illustrates how the movement or turning of the top sheet reveals that the second sheet in the stack also has a void or notch improvement in the shape of the sheet. The void or notch in the second sheet is out of alignment with the void or notch in the top sheet. FIG. 4 illustrates the placement of the finger or thumb in the void or notch of the second sheet in the stack and the removal of the finger or thumb from where the void or notch was when the top sheet was still in place, which allows the movement or turning of the second sheet in the stack while the movement or turning of the third sheet in the stack is stopped. FIG. 5 illustrates the top sheet and the second sheet of the stack after movement or turning from the stack and the placement of the finger or thumb in the void or notch of the third sheet which allows the movement or turning of the third sheet in the stack while the movement or turning of the fourth sheet is stopped.

FIG. 6 shows the user's finger 19 placed in the void or notch of one sheet of a stack being held in a curved condition by the left hand 14, the user's thumb 18 preventing the first sheet from turning, the thumb 18 being spaced a comfortable distance from the finger 19 and aligned at the spacing S from the finger 19 with the underlying notch or void of the second sheet as depicted in FIG. 7. FIG. 7 also shows the first sheet having been released by the thumb 18, which has been returned to its previous position while the finger 19 continues to restrain the second sheet. Thus the pages can be easily and reliably turned one-by-one simply by alternatingly lifting the thumb 18 and the finger 19 while maintaining both in alignment with respective sets of the alternating voids or notches of the odd and even sheets of the stack 12. More particularly, page turning proceeds with placing a thumb in the void or notch of one of an odd page and an even of the stack and against the next page; turning the one page while holding the thumb or finger against the next page; placing a finger in the void or notch of the next page of the stack and against a succeeding page; turning the next page while holding the finger against the succeeding page; keeping the thumb in proximate alignment with void or notch alignment of one of the odd and even pages; keeping the finger in proximate alignment with the void or notch alignment of the other of the odd and even pages; and alternatively releasing the thumb and the finger from respective next pages, thereby sequentially turning at least some of the pages of the stack without missing a page.

Figure 8:
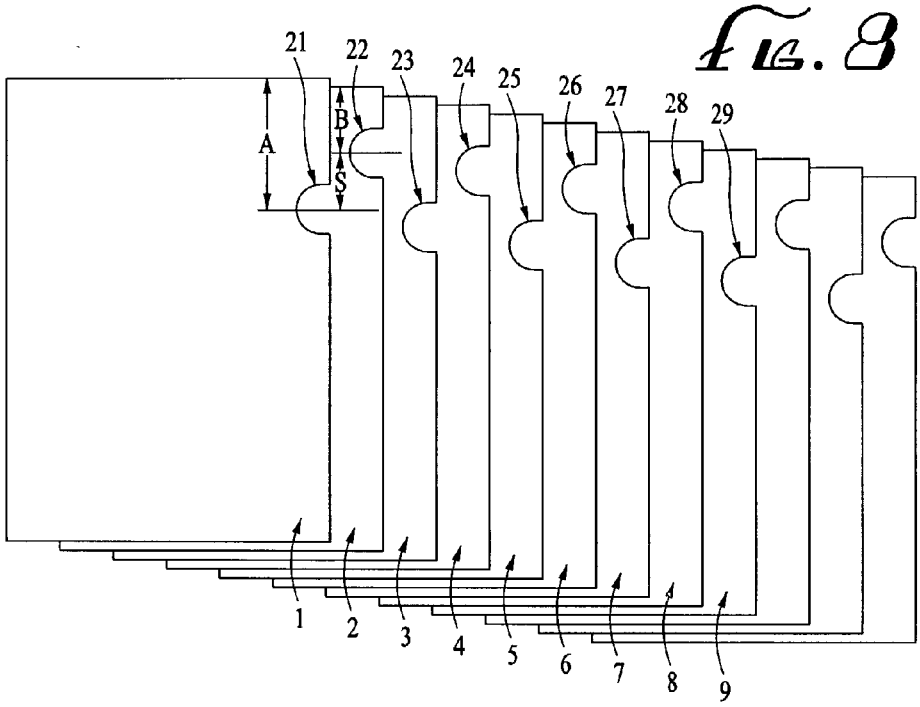
FIG. 8 is a plan view of sheets of material in a stack fanned out to reveal alternating void or notch shapes formed in each sheet.
Figure 9:
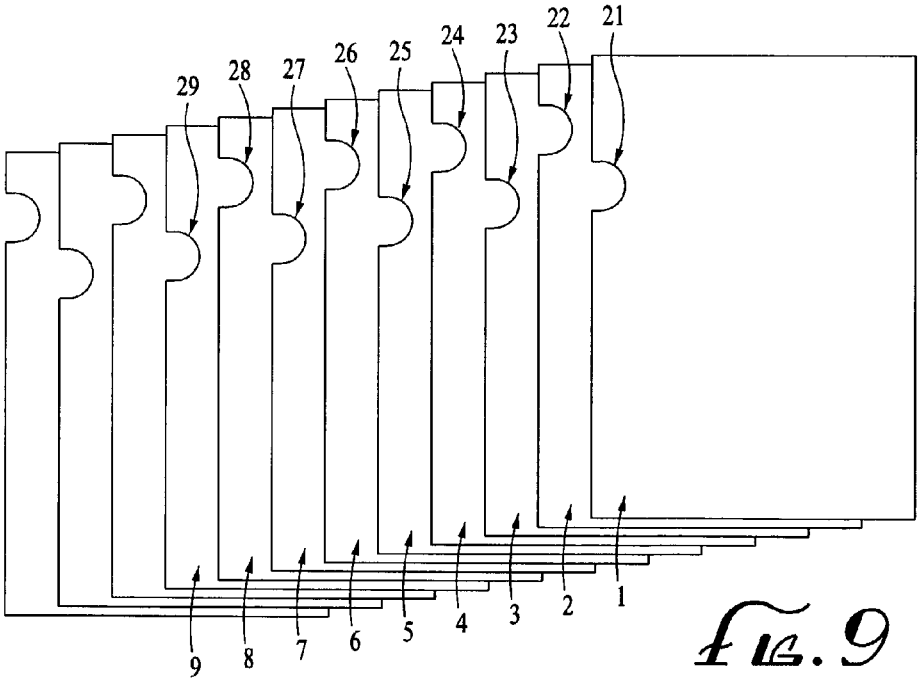
FIG. 9 is a plan view as in FIG. 8, showing the alternating voids or notches formed on different edges of the sheets.
Figure 10:
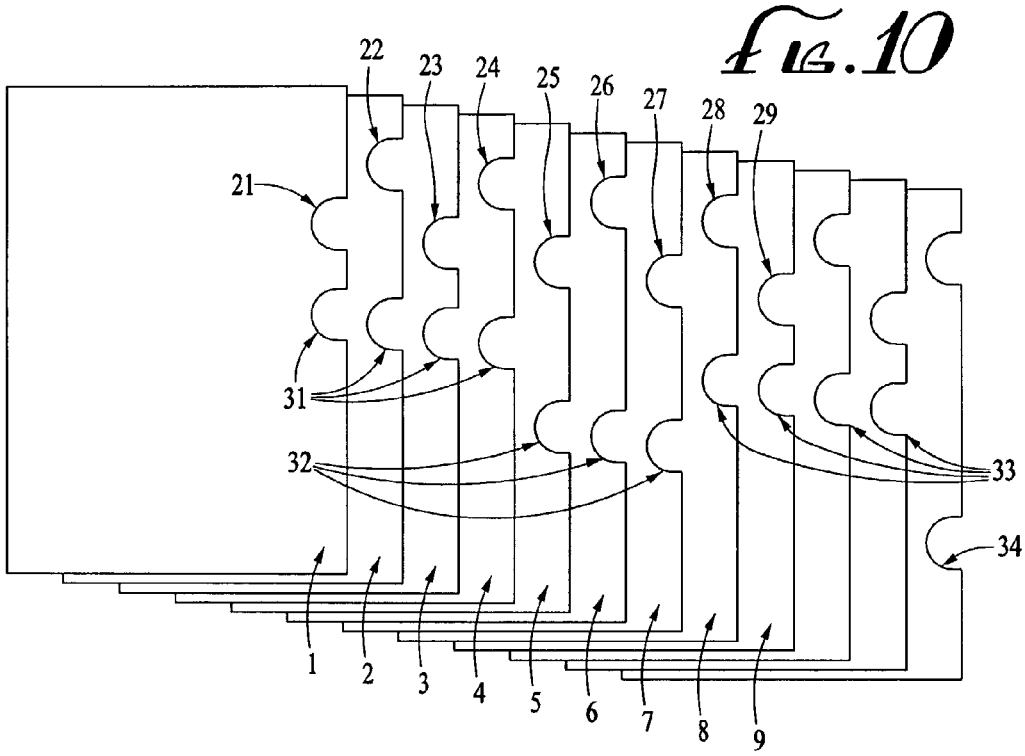
FIG. 10 is a plan view as in FIG. 8, showing an alternative arrangement of the voids or notches.
Figure 11:
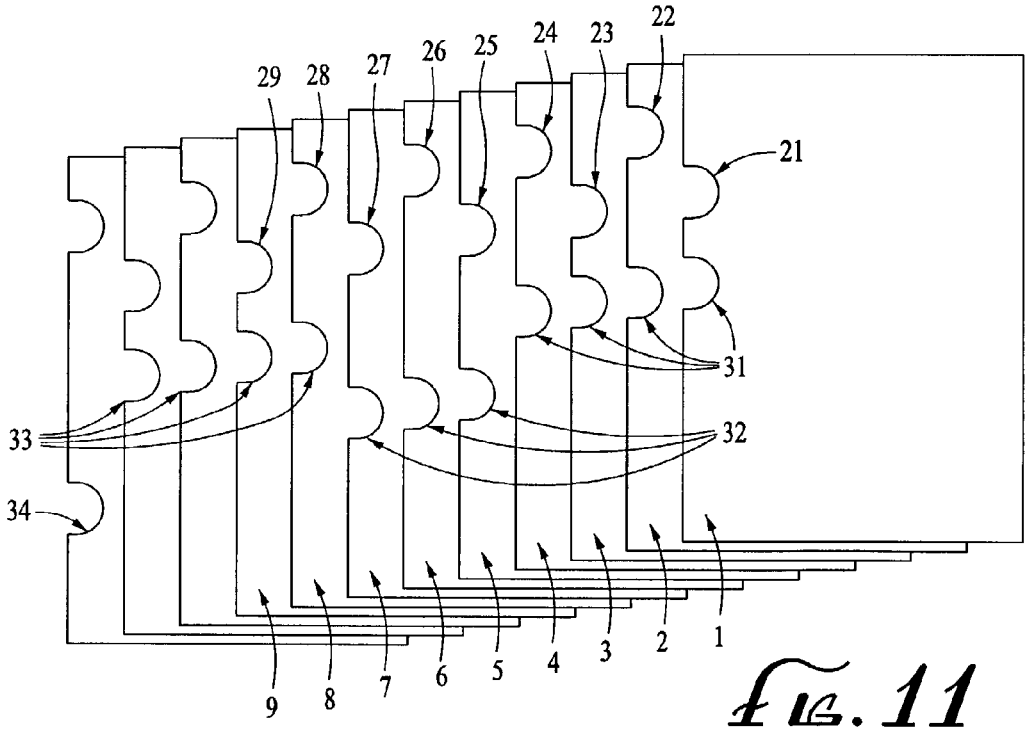
FIG. 11 is a plan view as in FIG. 8, showing the voids or notches formed on different edges of the sheets.
Figure 14:
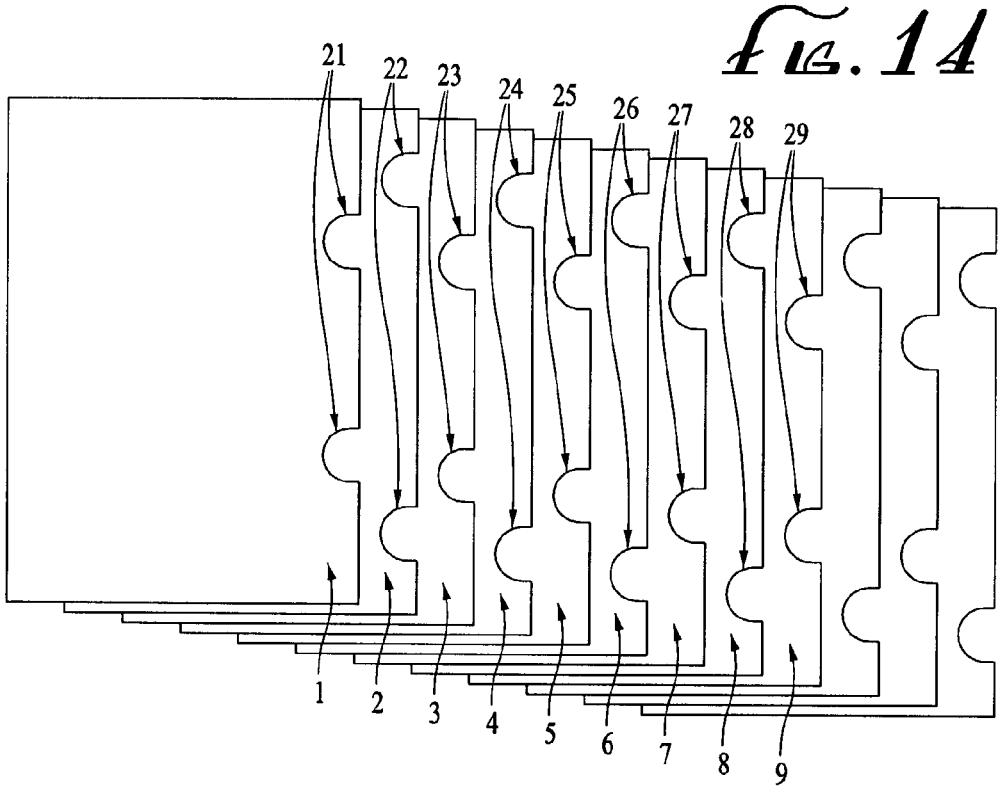
FIG. 14 is a plan view as in FIG. 8, showing an alternative arrangement of the voids or notches.
Figure 15:
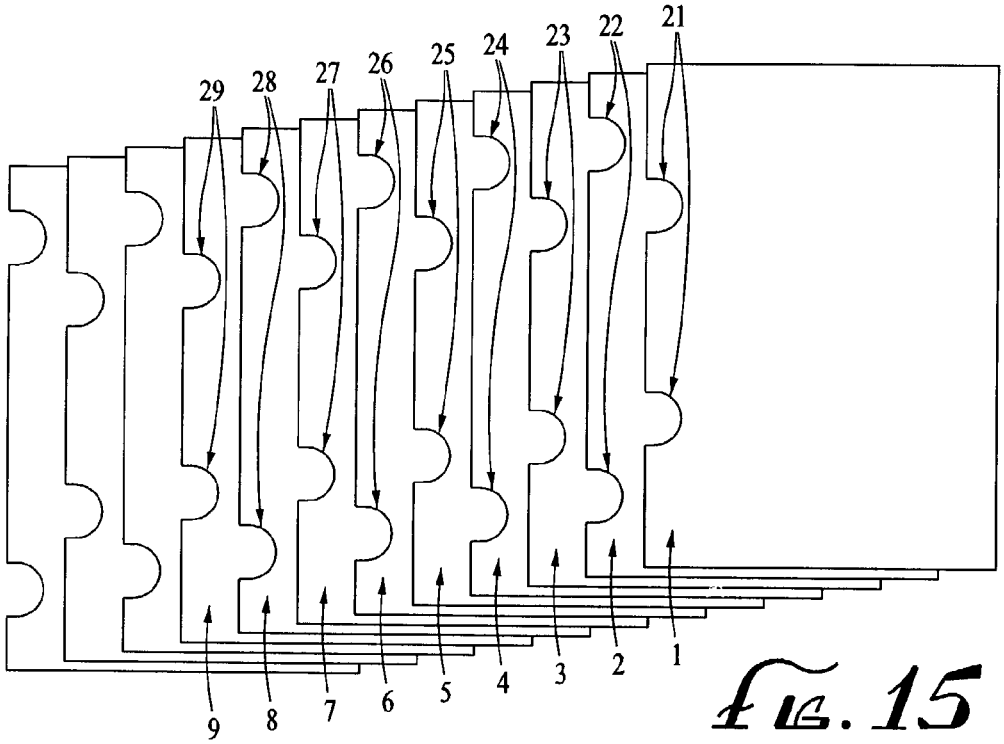
FIG. 15 is a plan view as in FIG. 14, showing the voids or notches formed on different edges of the sheets.
Figure 10:
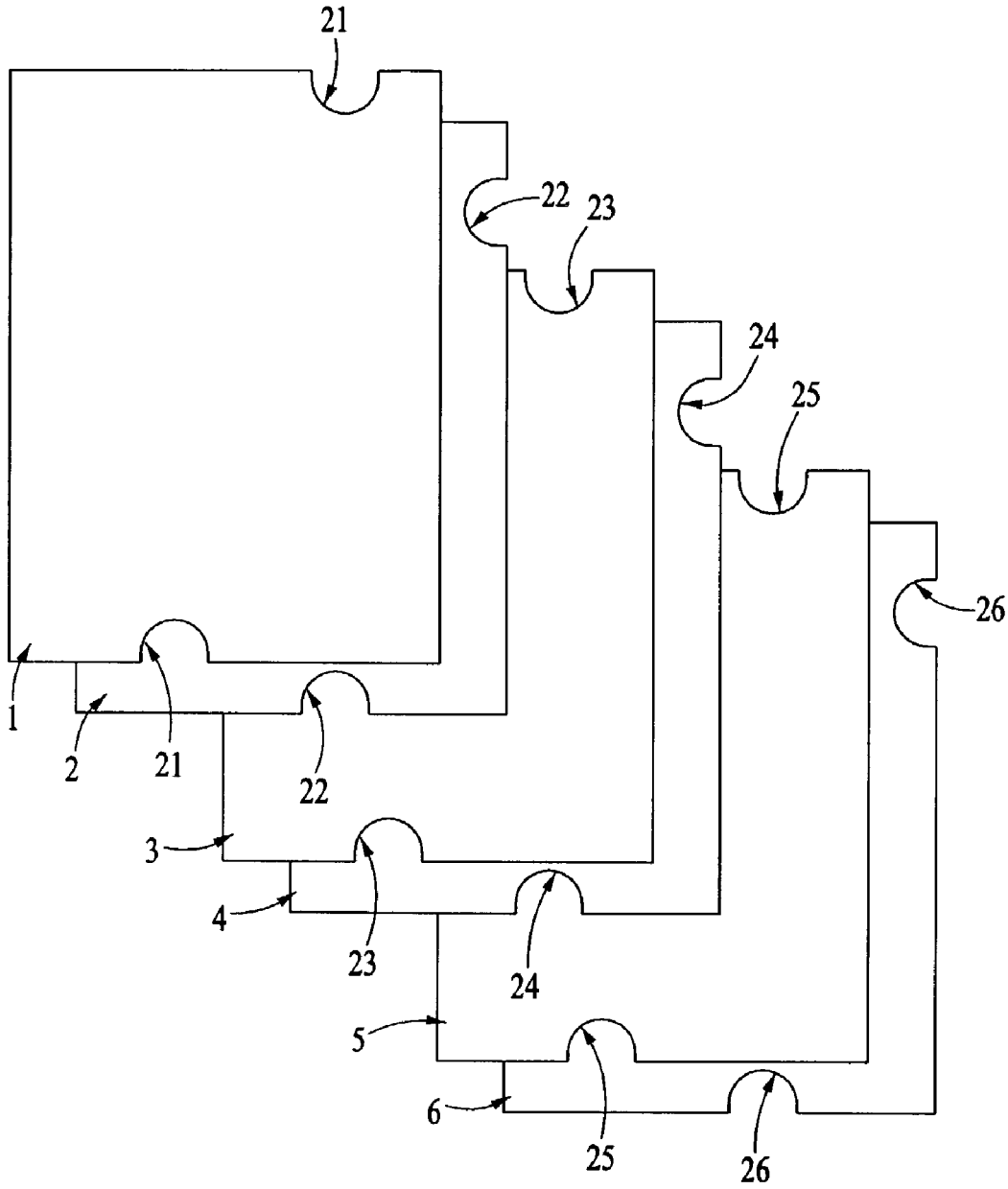

FIG. 8 shows the alternating shape improvements where the odd sheets align with each other. The even sheets align with each other. The odd numbered shape improvements (the voids or notches 21 and 23, as well as corresponding voids and notches 25, 27, and 29) do not align with the even numbered shape improvements (notch or void 22, as well as corresponding voids or notches 24, 26, and 28). FIG. 9 shows a left-handed version of the right-handed embodiment illustrated in FIG. 8. FIG. 10 shows the addition of voids or notches 31, 32, 33. and 34 that provide an alternating chapter or alphabetical letter or section or division of a stack of sheets. FIG. 11 is a left-handed version of the right-handed embodiment illustrated in FIG. 10. FIG. 12 shows alternative placement locations for the shape improvements. FIG. 13 is a left-handed version of the right-handed embodiment illustrated in FIG. 12. It is contemplated that the void or notch shape improvements can be located on any edge and/or side of the sheets of material. FIG. 14 shows the alternating void or notch shapes located in multiple places along the edges of the sheets of material. FIG. 15 is a left-handed version of the right-handed embodiment illustrated in FIG. 14. FIG. 16 shows the alternating void or notch shape improvements located in multiple places along multiple edges of the sheets of material. It is further contemplated that the void or notch shape improvements can be located near or on any corner, and/or anywhere along the top, bottom or sides of the sheets of material. The method and variations thereof described above also allow the sheets of the stack under the void or notch to be pushed downward so the edge of the void or notch can be hooked and/or lifted and turned over with a press and flip motion of the user's hand. These are examples of several of the preferred sheet configurations to be provided by the present invention, it being understood that the invention is not limited to providing the examples illustrated.

With further reference to FIGS. 17–23, the present invention also encompasses variant forming means, including but not limited to cutting, drilling and/or punching, to produce inward from the edge of each sheet at least one void or notch shape cut which alternates position with each successive sheet in a stack of sheets which results in a product comprising a stack of sheets with shape improvements that allow the indexing function. The apparatus can function independently or be unified with a printer, copier, fax machine, or any other machine dealing with paper or flexible material.

Figure 17:
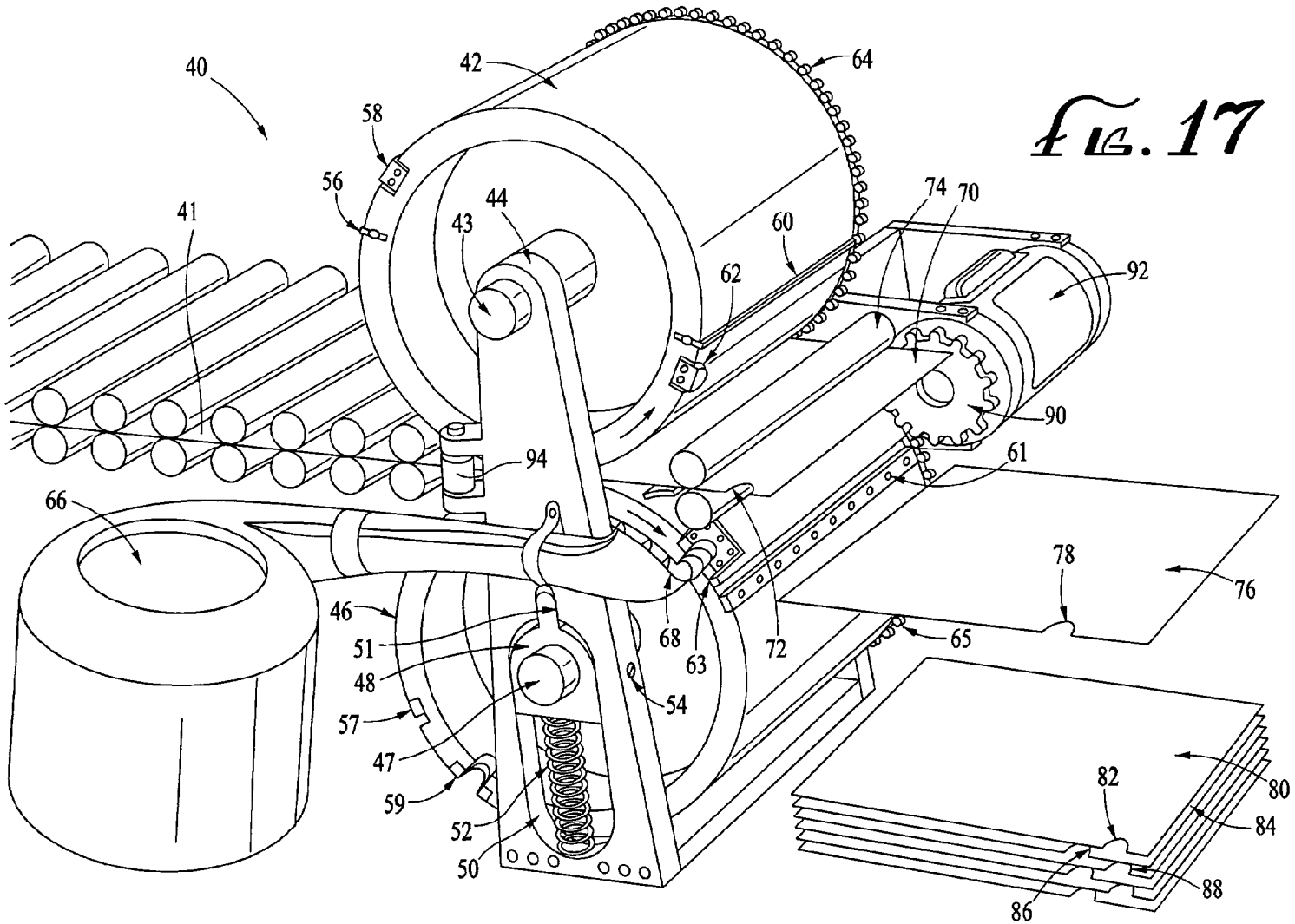
FIG. 17 is a perspective view of a cutting machine for producing stacked sheets having alternating voids or notches according to the present invention from a web of sheet material.

More particularly, FIG. 17 illustrates a sheet material cutting machine 40 that creates one embodiment of the sheet turning device 10 from advancing sheet material 41. Although any size of sheet of material is covered by this innovation, standard letter size paper would be a proper representative sample for illustrative purposes. The exemplary form of the machine 40 shown in FIG. 17 includes a counter-clockwise-rotating (CCW) drum 42 having a CCW axle 43 rotating in a support frame 44. Similarly, a clockwise (CW) drum 46 having a CW axle 47 is rotatably supported in a pair of carriers 48 that slidably engage respective main channels 50 and an alignment channels 51 of the support frame 44, the CW drum 46 being biased against the CCW drum 42 by a pair of springs 52. Thus the material 41 is squeezed and advanced between the drums 42 and 46 as they rotate against each other, relative alignment of the drums being further effected by an alignment screw 54 that threadingly engages one or both of the frame 44 and the carrier 48. It will be understood that precise alignment of the drums 42 and 46 can be by any suitable means known to those skilled in the web-printing art.

As the CCW and CW drums 42 and 46 rotate, an even sheet cutter blade 56 of the CCW drum 42 slices the advancing sheet material 41 against an even cutter anvil 57 of the CW drum 46, thereby defining a transverse sheet edge, an even sheet die cutter 58 of the drum 42 and an even die anvil 59 of the CW drum 46 subsequently forming a notch at a predetermined distance from the previously formed transverse sheet edge. During further rotation of the drums 42 and 46, an odd sheet cutter blade 60 of the CCW drum 42 (opposite the even blade 56) slices the material 41 against an odd cutter anvil 61 of the CW drum 46, separating a sheet from the material 41 and forming a counterpart transverse edge of the material 41, an odd sheet die cutter 62 of the CCW drum 42 and an odd die anvil of the CW drum 46 forming a counterpart notch at a different predetermined distance from the newly formed transverse edge of the material 41, the difference in the predetermined distances corresponding to the spacing S of odd and even sheet voids or notches 21 et seq. The drums 42 and 46 are driven in synchronization with each other, the CCW drum 42 having a CCW gear 64 rotating therewith, in mesh with a CW gear 65 of the CW drum 46 to maintain precise cutter alignment, the alignment being slightly adjustable by means of the above-described adjustment screw 54.

An air vacuum device 66 is connected for sucking die-cut waste paper through a vacuum tube 68 that is aligned for receiving such waste proximate the path of the die anvils 59 and 63 downstream of the contacting regions of the drums 42 and 46.

As further shown in FIG. 17, an odd sheet 70 being formed by the machine 40 and having an odd void or notch 72 is further advanced by a pair of exit rollers 74, a presently formed even sheet 76 having an even void or notch 78 falling onto a previously formed odd sheet 80 having an odd void or notch 82. These sheets are stacked on other previously formed sheets, an even sheet 84 having an even void or notch 86, etc. Thus the even voids or notches 78 and 86 are out of alignment with interleaved odd voids or notches 82 and 88.

A drive gear 90 that engages the CW gear 65 is powered by a motor 92 for driving the drums 42 and 46, the exit rollers 74 being suitably powered by any suitable means (not shown) for clearing the severed sheets from the drums 42 and 46 and forming the stack of completed sheets. The sheet material 41 is maintained in lateral alignment by any suitable means such as alignment rollers engaging opposite side edges of the material 41, one such roller being shown in FIG. 17 at 94.

Figure 18:
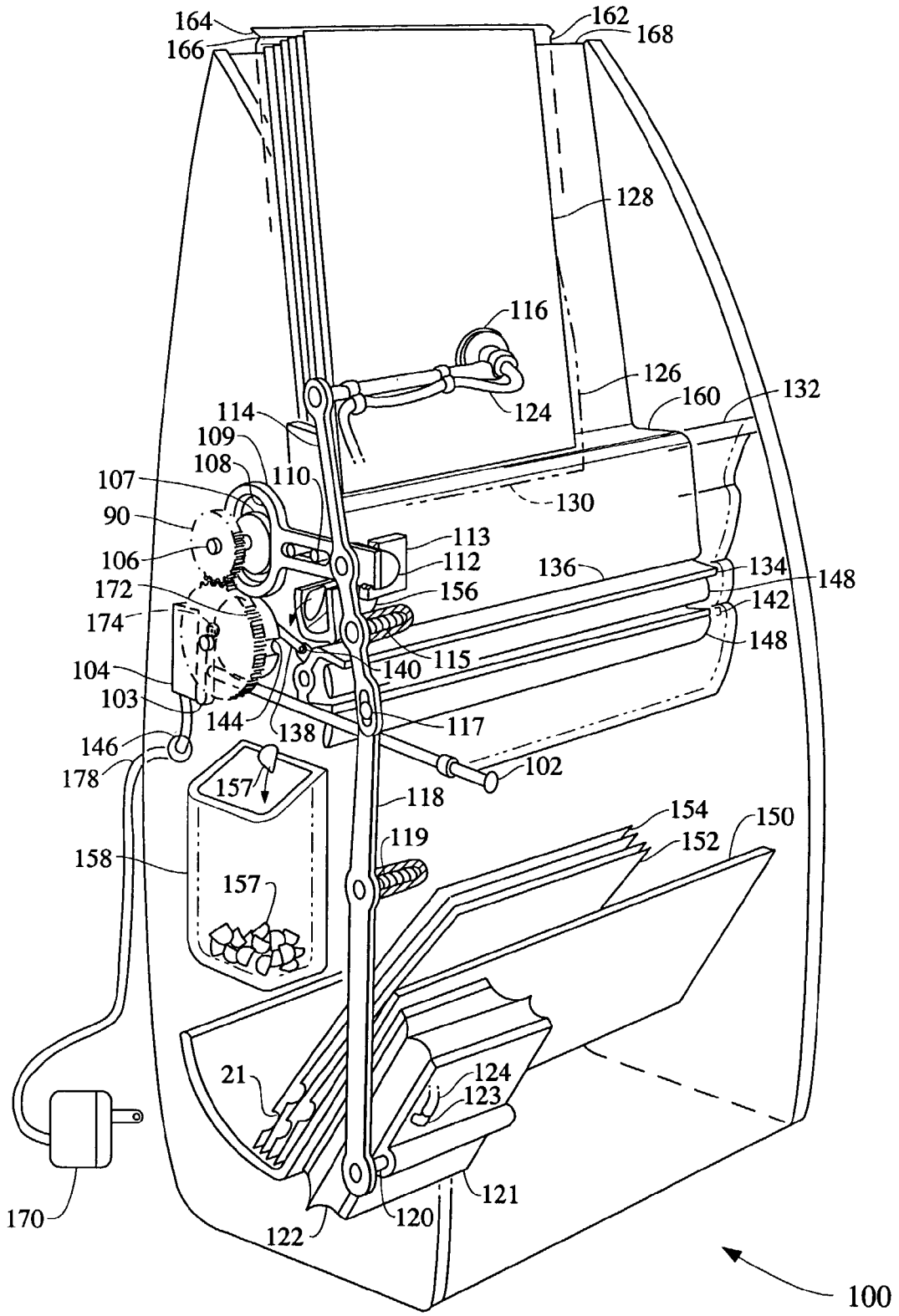
FIG. 18 is a perspective partially phantom view of a machine for producing alternating voids or notches in stacked sheets according to the present invention.

With particular reference to FIG. 18, a notching machine 100 is configured for forming the device 10 from stacked precut sheets. A start button 102 of this machine operates a switch lever 103 for closing a momentary-on power switch 104, thereby activating a suitable motor (not shown) to cause a motor shaft 106 to rotate an eccentric cam 107 that engages a slot 108 of an arm 109 for reciprocal movement thereof, the arm being linearly guided by a pair of guide pins 110. Initially, the movement of the arm 109 displaces a die punch 112 to an open position relative to a die anvil 113, and also causing an actuator arm 114 to pivot on an actuator pin 115, the arm 114 having a suction cup 116 at an upper extremity thereof. Also, the actuator arm 114 slideably engages a drive pin 117, pivoting a bottom arm 118 on a bottom pivot 119, a lower extremity of the bottom arm 118 thereby displacing a bellows pivot 120 that engages a bellows plate 121 for expanding a bellows 122. The bellows 122 is fluid-coupled through a nipple 123 and a vacuum tube 124 to the suction cup 116 so as to clampingly attract a single sheet 126 from an upper stack 128 of precut sheets as the suction cup 116 is brought into contact with the stack, a leading portion 130 of the sheet being directed toward a contoured gate member 132 as the suction cup moves away from the stack as shown in FIG. 18. At the same time, the movement of the actuator arm 114 is reversed, causing the single sheet 126 to be released as the bellows 122 blows instead of sucking as the eccentric cam 107 further rotates to cause the change of motion.

The released single sheet 126 of paper then falls by gravity through the mouth of the die punch 112 and anvil 113 and onto an alternating height paper stop 136, the stop being pivoted into its upper position as indicated at 134 in FIG. 18, the sheet 126 being cut by the punch 112 to form a void or notch as described above (even). A next piece of paper from the upper stack 128 is similarly fed, but with the paper stop 136 being pivoted to a lower stop position 142 by an eccentric control link 138. The link 138 is coupled between a link coupling 140 that projects from the paper stop 136 and a rotating cam gear 172 that is driven at half-speed by a counterpart of the drive gear 90 that rotates with the motor shaft 106, the cam gear 172 having an opposed pair of notches 144 formed thereon for engagement by a roller follower tip 174 of the switch lever 103. The switch lever 103 operates the power switch 104 as described above for powering the motor from a wall transformer 170 that is coupled through a power cord 178, the power cord 178 being conventionally anchored by a strain relief 146. The combination of the start button 102, the switch lever 103, the power switch 104, and the cam gear 172, provides that the machine 100 runs continuously until the button 102 is released, the machine stopping at 0 or 180 degree positions of the cam gear 172 when the button 102 is released.

Thus the eccentric control link 138 pivots the paper stop 136 to project into the upper stop position 134 for one rotation of the motor shaft 106 and to occupy the lower stop position 142 for the next rotation of the motor shaft 106, and repeating thereafter to produce an alternating pattern of stopping the paper at different heights for each cut of the die punch 112. A vertically spaced pair of guide bars 148 are located above and below the lower stop position of the paper stop 136, the guide bars 148 and a lower extremity of the upper tray serving to fend the leading sheet portions from retracting portions of the paper stop 136, thereby facilitating gravity feed of the single sheets 126.

A refuse chute 156 directs punched scrap 157 into a refuse collection bin 158. Also, the upper stack 128 is supported in an upper tray 168 having a shelf 160 and an extendable upper support extension 162, the support extension having a handle 164 that projects upwardly and rearwardly from a barb 166 that defines a lower travel limit relative to the upper tray 168.

After the single sheets 126 are die cut to form the voids or notches 21, etc., in proper alternating position, they fall to a lower shelf 150 as indicated at 152, forming a lower stack 154 of the sheets, the lower stack 154 being in the same order and orientation as the upper stack 128. The completed lower stack 154 is removable from the machine 100 by withdrawal upwardly and forwardly from the lower shelf 150. Die cut sheet refuse from the die punch 112 slid down a refuse chute 156 into a refuse collection bin 158 for disposal and recycling.

Figure 19:
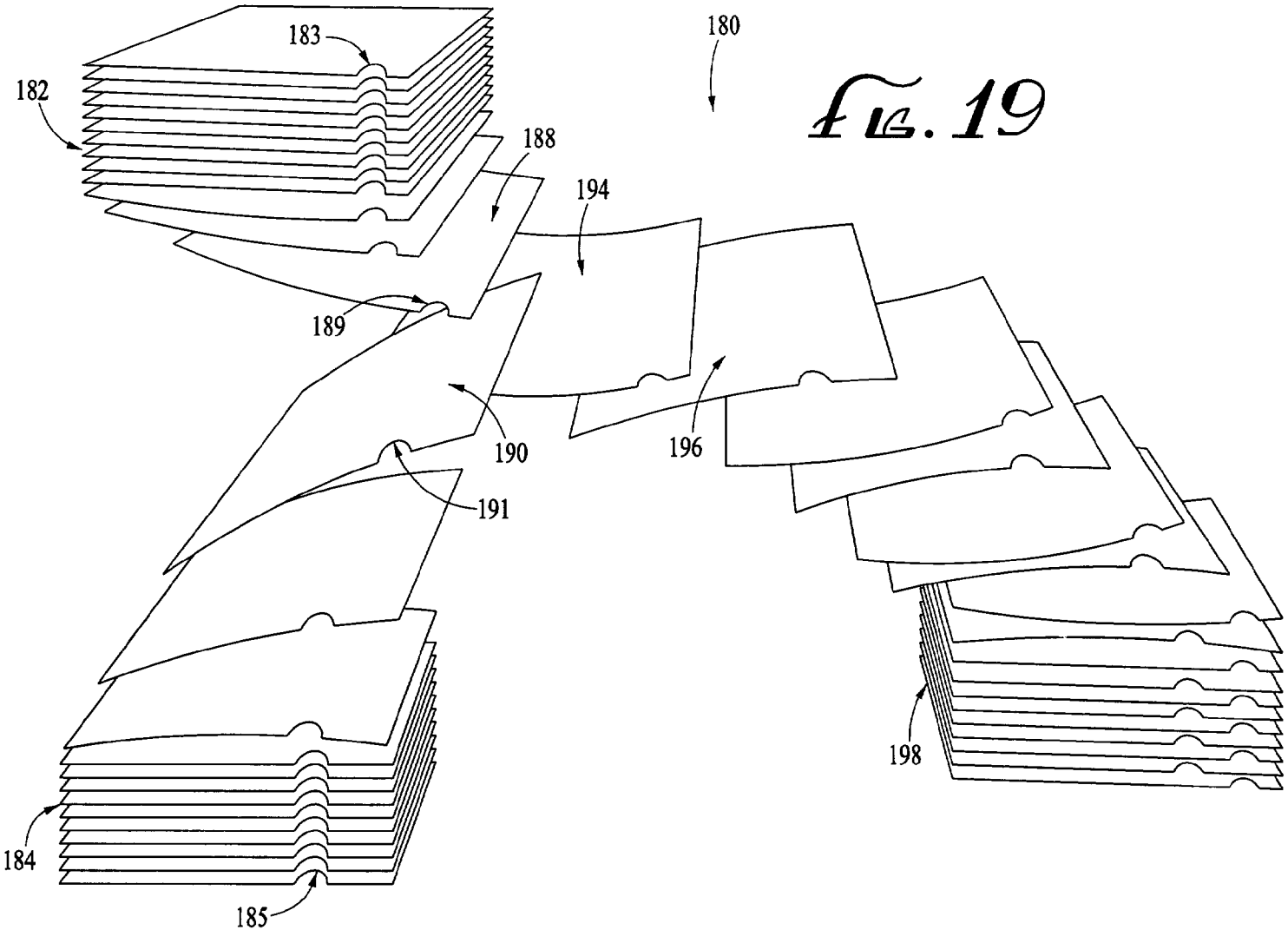
FIG. 19 is a perspective view showing a process of interleaving odd and even notched sheets according to the present invention.

As shown in FIG. 19, the device 10 of the present invention can be produced in a sheet conversion process 180, which is contemplated to be performed either manually or with suitable commercially available equipment. In an exemplary form, the process 180 includes providing an even sheet stack 182 having even spaced voids or notches 183 aligned therein, and a separate odd sheet stack 184 having odd spaced voids or notches 185 aligned therein. An even sheet 188 having an even void or notch 189 is withdrawn and advanced from the even sheet stack 182, and an odd sheet 190 having an odd void or notch is withdrawn from the odd sheet stack and advanced below the even sheet 188, but above an even moving sheet 194 having been previously fed from the even sheet stack. The even moving sheet 194 itself is moved over a yet previously fed odd moving sheet 196, in a stream of alternating sheets which is fed onto and forming a counterpart of the sheet turning device of the present invention, designated 198 in FIG. 19. In the exemplary form of the process 180 shown in FIG. 19, even sheets are fed from the bottom of the even sheet stack 182 whereas odd sheets are fed from the top of the odd sheet stack 184. It will be understood that the relationship of the stacks can be reversed, and further that the feeding can be from either the top or bottom of both stacks; moreover, the stack forming the sheet turning device 198 can be fed from the bottom rather than the top. In any case, the process 180 facilitates utilization of sheet stacks 182 and 184 having the respective voids or notches formed therein by punch or shear operations on the stacks as a whole. More generally, the sheets being used do not have to be stacked initially, but may rather be sets of sheets from any respective forming operations that produce the voids or notches voids or notches 183 and 185. Additionally, there may also be more than two sets of the sheets. Thus the sheets of each set have the notches or voids in matching configurations and offset from the notches or voids of the sheets not included in the same set, and the process can be characterized as (a) providing a first supply of sheets of a first set of the sheets; (b) providing a second supply of sheets of a second set of the sheets; (c) advancing an nth sheet from the first supply in a feed path; (d) advancing an nth+1 sheet from the second supply into stacked relation to one surface of the nth sheet; (e) advancing an nth+2 sheet from the first supply into stacked relation to the nth+1 sheet opposite the nth sheet; and (f) repeating (d) and (e) with n incremented by two in each instance for completing the device as a stack of sheets having the void or notch shapes alternating in position with each successive sheet in the stack. In the above sequence, "In" is a number that represents particular sheets of the device 10 being formed in the process 180.

Figure 20:
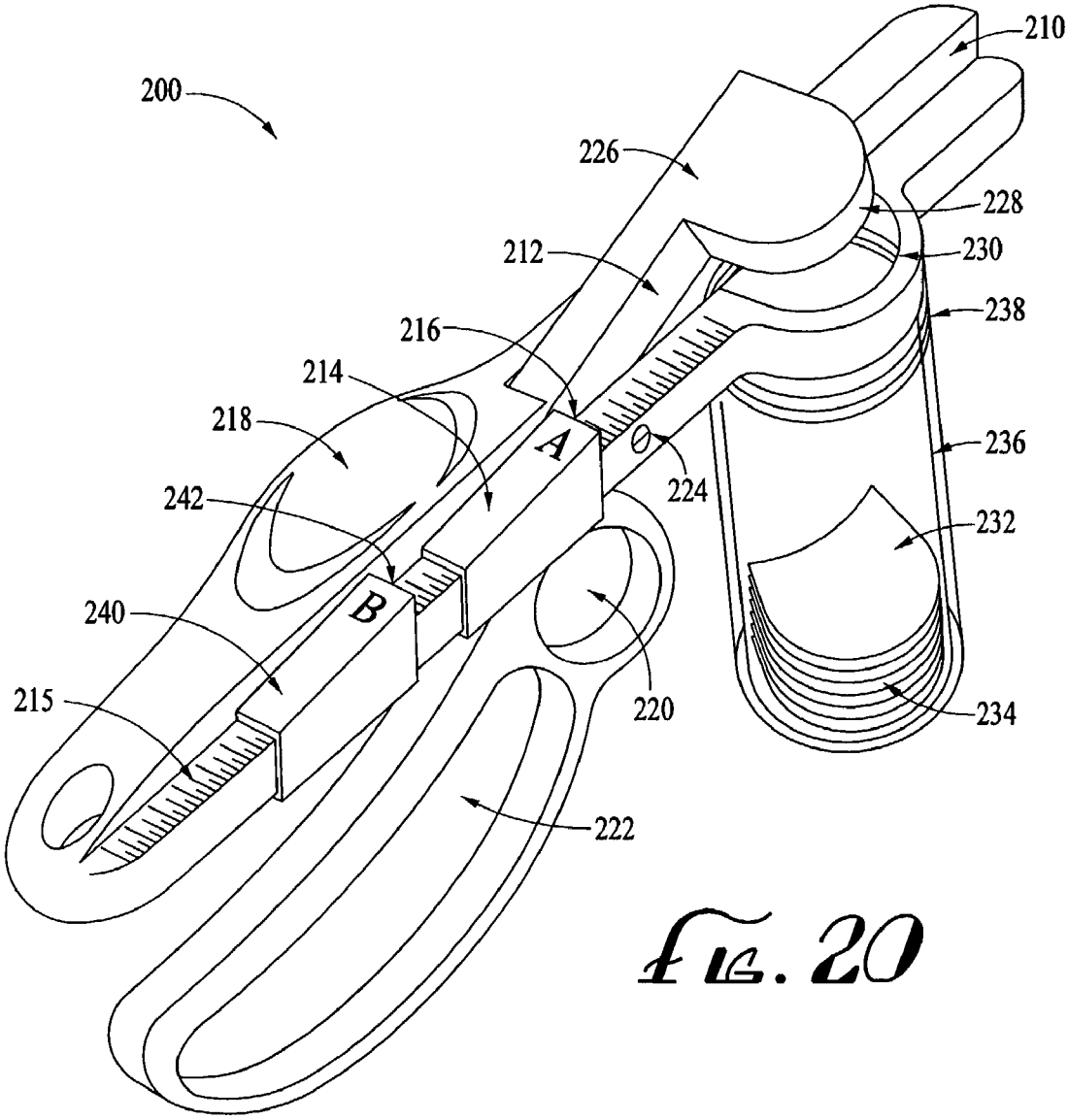
FIG. 20 is a perspective view of a hand-operated punch for producing the alternatingly aligned voids or notches.

As shown in FIG. 20 a hand punch 200 provides a low cost alternative to the notching machine 40. The punch 200 includes a stationary edge guide 210 and a coplanar moving (pivoting) edge guide 212 for alignment of sheets to be punched. A first slidable block 214 has a first stop edge 216 for registration of alternating (even, for example) sheets, the block 214 being identified such as with the indicia "A" in FIG. 20. The block 214 is slidably supported on an integrally formed continuation of the stationary edge guide 210, which has scale indicia 215 formed thereon to facilitate repeatable positioning of the block 214. A thumb grip 218 is also integrally formed with the stationary edge guide 210, the hand punch 200 being held in the hand in the manner of scissors, a finger grip 220 and a hand grip 222 being integrally formed with the moving edge guide 212, which is pivotably connected to the stationary edge guide 210 at a fulcrum 224. The moving edge guide 212 forms a cutter arm 226 having a die punch 228 formed thereon, the punch 222 being closed against a die anvil 230, the anvil 230 being integrally formed with the stationary edge guide 210, by squeezing of the finger and hand grips 220 and 222 toward the thumb grip 218 for forming a void or notch by cutting a waste paper blank 232 from each successive sheet being cut by the hand punch 200. The blanks 232 form a waste stack 234 in a waste container 236 that is removably supported under the stationary edge guide 210 by a connector 238.

A second slidable block 240 having a second stop edge 242 (and being identified with the indicia "B") is also slidably supported on the continuation of the stationary edge guide 210 for registration of alternating (odd) sheets to be punched. Advantageously, the sheets to be punched are aligned on opposite sides of the die cutter 228 and anvil 230 against the stationary and moving edge guides 210 and 212, being conveniently positioned for alternating alignment of the voids or notches to be formed by alternate engagement of the sheets against the first and second stop edges 216 and 242 of the first and second slidable blocks 214 and 240. It will be understood that the blocks 214 and 240 incorporate suitable spring members (not shown) for frictionally retaining same as positioned by the user. Similarly, another spring member (not shown) can be coupled between the stationary edge guide 210 and the moving edge guide 212 for biasing the hand punch 200 toward the open condition shown in FIG. 20. It will be understood that the hand punch 200 of FIG. 20 has a non-symmetrical (right-handed) configuration, and that an opposite (left-handed) configuration is also contemplated within the scope of the present invention.

Figure 21:
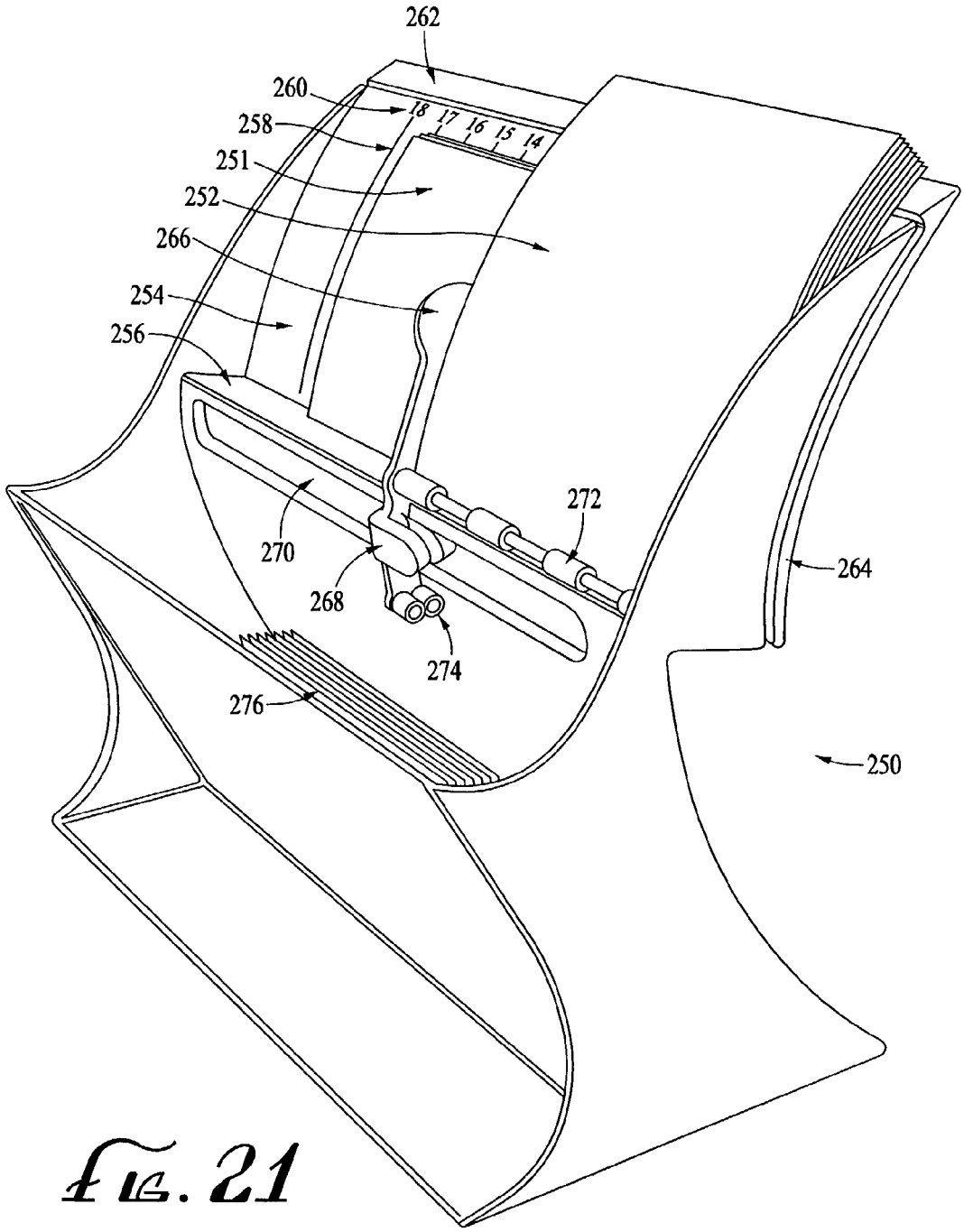
FIG. 21 is a perspective view showing a machine for producing a programmed sequence of alternating voids or notches in stacked sheets.

FIG. 21 shows an alternative configuration of the notching machine of FIG. 18, designated notching machine 250, that provides programmed positioning of the voids or notches being formed in stacked sheets which can be of large format (in either landscape orientation as indicated at 251 or portrait orientation as indicated at 252). The machine 250 includes a paper tray 254, a tray shelf 256 outwardly projecting from a lower extremity of the tray 254, which also has a series of vertically oriented alignment rules 258 and a measurement scale 260 for facilitating positioning of the paper stacks 251 and 252. A paper support edge 262 is also extendable above the paper tray 254 on a tray extension 264.

A vertically oriented alignment guide 266 projects from a die cutter head 268 that is horizontally adjustable along a cutter track 270, the guide 266 being positioned against the left side of the landscape stack 251 or the portrait stack 252 as the case may be (positioning against the stack 252 being shown in FIG. 21). A plurality of computer controlled primary advance rollers 272 are coaxially supported in horizontally adjustable locations between the alignment guide 266 and the right side of the paper tray 254 for feeding single sheets from the stack 252 (or 251) and controllably advancing same along the alignment guide 266. With the leading edges of each sheet positioned to predetermined positions beyond the die cutter head 268, the cutter head is activated to cut the above-described void or notch therefrom. Computer control of the predetermined positions is provided using methods that are well within the ordinary skill of those in the computer control arts. After cutting, a pair of secondary advance rollers 274 may be used for clearing the sheets from the die cutter head 268 and feeding same onto a face-up, ordered sheet stack 276 ready for removal from the front of the machine 250. It will be understood that plural voids or notches can be formed in selected sheets under computer control for facilitating rapid turning of sheets to chapter headings and the like as described above in connection with FIGS. 10 and 11.

Figure 22:
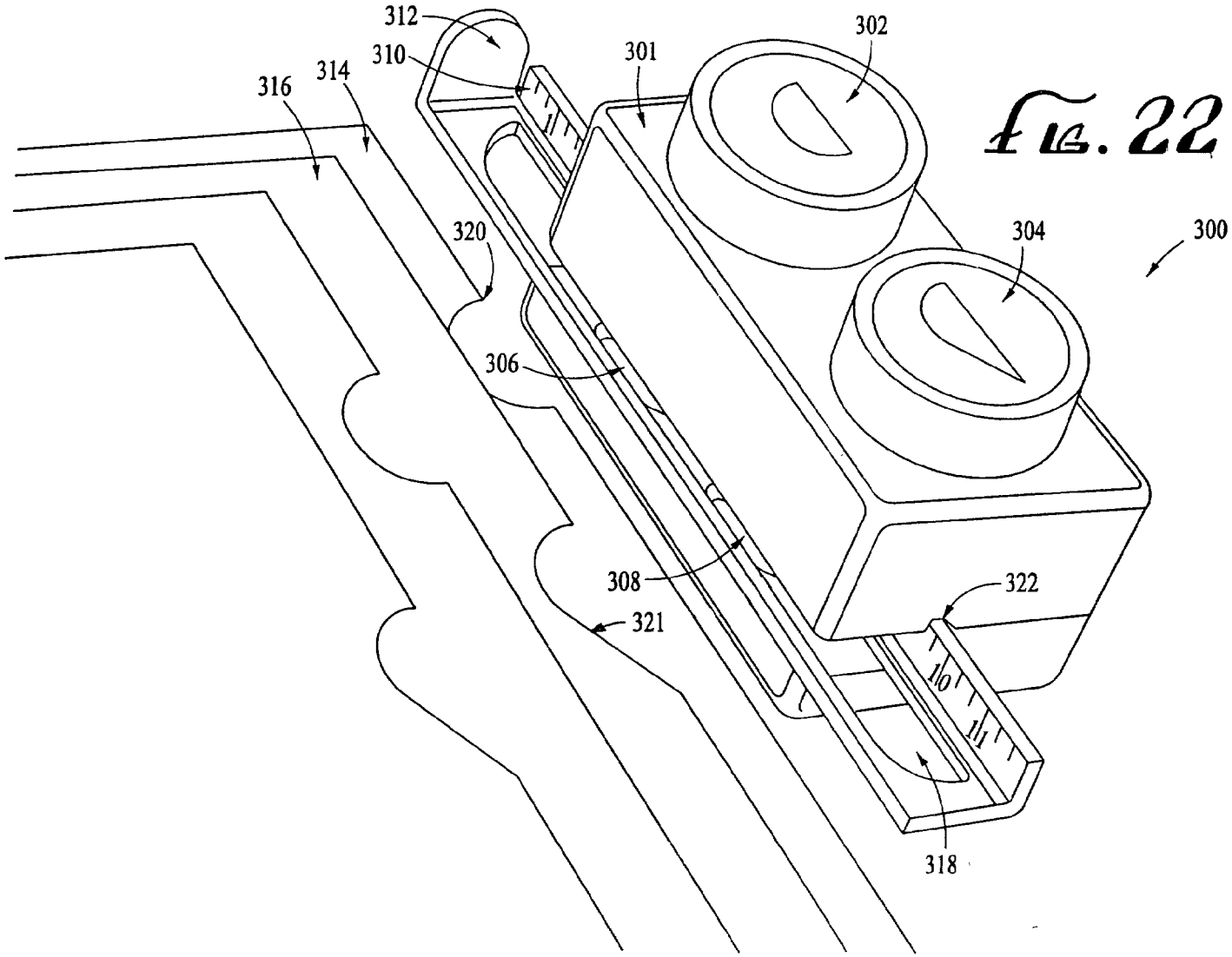
FIG. 22 is a perspective view showing an alternative configuration of the hand-operated punch of FIG. 20.

FIG. 22 shows an alternative configuration of the hand punch of FIG. 20, designated 300, includes a base or body 301 for axially slidably supporting a first die button 302 and a second die button 304 at a fixed spacing (the spacing S of FIGS. 7 and 8, for example). The buttons 302 and 304 are spring loaded for movement out of engagement with respective first and second die anvils 306 and 308. An alignment scale 310 having a corner stop 312 is also slidably supported by the body 301 for alignment of a first paper sheet 314, a next sheet 316, etc., in space between the die buttons 302 and 304 and the respective die anvils 306 and 308, the scale 310 having an elongate clearance opening 318 for permitting adjustment of the scale relative to the body 301 for a predetermined offset distance from the corner stop 312 and a void or notch 320 to be cut in the first sheet 314 by the first die button 302 (in correspondence with the distance B of FIG. 8). The body 301 is provided with suitable means (not shown) for frictionally engaging an engagement surface 322 of the scale 310 to yieldably hold same in fixed relation to the body 301.

In operation, the first die button 302 is operated with first sheet 314 registered against the scale 310 and the corner stop 312 thereof, and the second die button 304 is operated with the first sheet 314 replaced by the next sheet 316, the process being repeated for subsequent pairs of sheets.

As shown in various ones of the drawings, and in particular FIG. 22, the respective voids or notches formed in the device 10 of the present invention may be differently shaped. For example, the void or notch 320 of the first sheet 314 is generally semi-circular, the first die button 302 being marked correspondingly. On the contrary, the second die button 304 is marked for forming an arcuate/beveled void or notch 321 in the next sheet 316, the different shapes of the voids or notches facilitating operation of the sheet turning device 10 of the present invention by functioning in cooperation with the thumb and/or fingers and other parts of the human hand to facilitate the ease of quickly turning pages in a stack of documents one by one, without accidentally missing a page. The different shapes of the voids or notches also facilitate operation of the sheet turning device 10 of the present invention by permitting tactile discrimination between the voids or notches present in respective even and odd sheets of the device 10. This feature of the present invention is available in the embodiments of FIGS. 17, 19, 22, and 23 (described below). Further, the notching machine 250 of FIG. 21 can also cut different shapes by providing the die cutter head 268 with plural punch and die sets having the different shapes. The computer control would utilize appropriate separate offset distances to the respective die sets in registering the corresponding sheets to be punched. Alternatively, separate in-line die cutter heads would incorporate the differently shaped punch and die sets.

Figure 23:
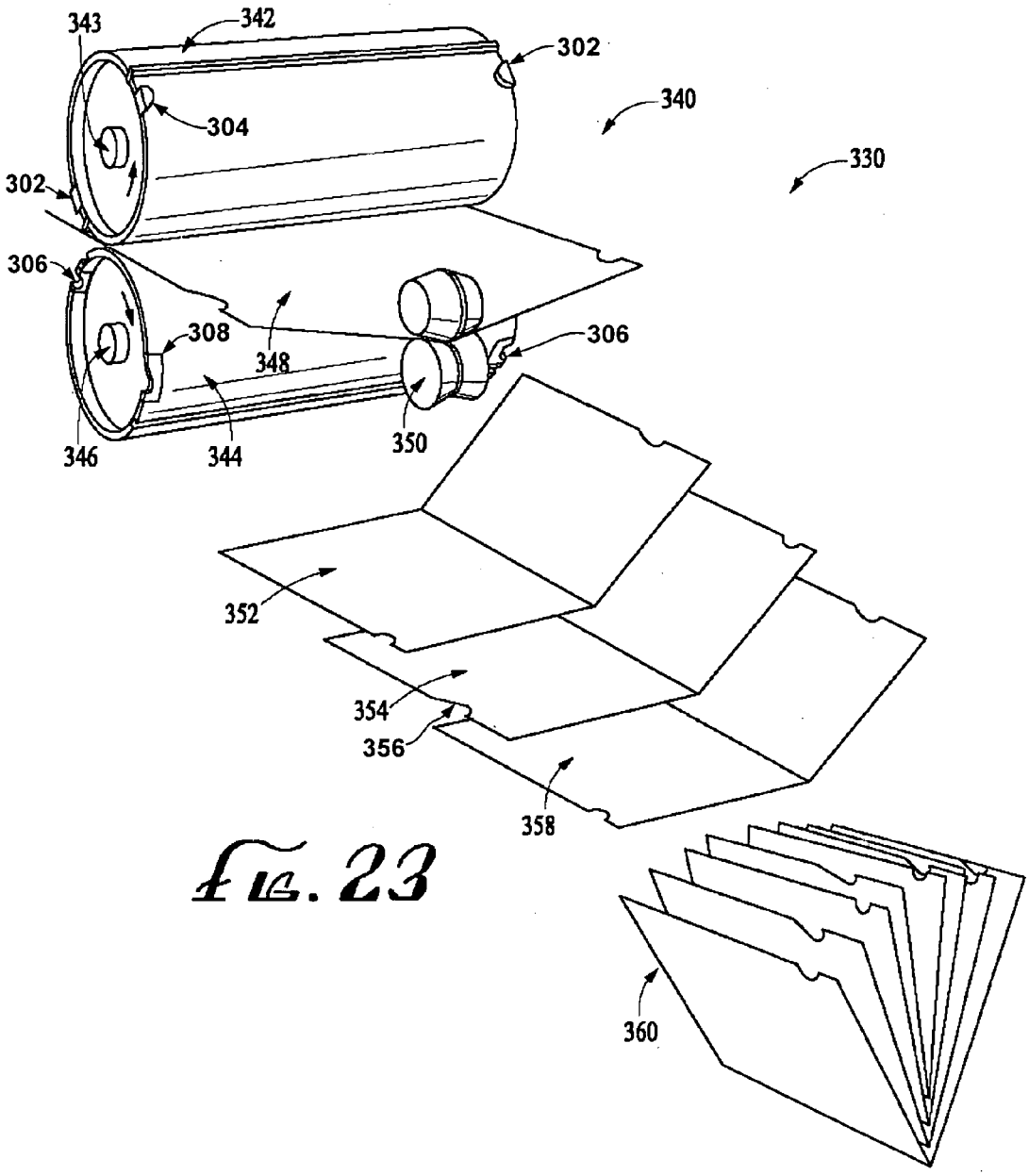
FIG. 23 is a perspective view of a process of interleaving pairs of sheets having alternating voids or notches using an alternative configuration of the cutting machine of FIG. 17.

FIG. 23 shows a process 330 for forming folded pairs of sheets using an alternative configuration of the cutting machine of FIG. 17, designated 340. The cutting machine 340 has counterparts of the CCW drum and axle, designated 342 and 343, and of the CW drum and axle, designated 344 and 346, but with die cutters and anvils at opposite ends thereof for forming respective voids or notches along opposite edges of a double-wide web of sheet material. As the drums 342 and 344 rotate, an even sheet 348 is cut from the web as described above, convexly and concavely beveled counterparts of the exit rollers, designated 350, progressively fold the sheet 348 to form a pair of pages. In similar manner as described above, the exit rollers 350 also feed the even sheet 348 in a path behind and over an odd sheet 352,. another even sheet 354 having voids or notches 356 formed therein that are out of alignment with those of a previous odd sheet 358 that is identical to the odd sheet 352, etc., onto a folded sheet stack 360, thereby forming a counterpart of the sheet turning device 10 of the present invention.

Although the present invention has been described in considerable detail with reference to certain preferred versions thereof, other versions are possible. For example, the notching machine 100 of FIG. 18 can be provided with means for maintaining continuous operation without having to keep pressing the start button 102, such as by including a toggle mechanism coupled between the button and the switch lever 103, or by using an electrical switch wired in parallel with the power switch 104, preferably with the inclusion of a suitable paper-out interlock for terminating operation once a full stack is processed.

The notching machine 250 of FIG. 21 can have the secondary advance rollers configured as the exit rollers 350 of the cutting machine 350 of FIG. 23, the machine 250 incorporating guide 266, and the die counterparts of the alignment guide 266, and the die cutter head 268 to form folded pairs of pages from the single sheets. Also, the machines of FIGS. 17, 18, 21, and 23 can include printing heads for combining cutting and printing functions. Therefore, the spirit and scope of the appended claims Should not necessarily be limited to the description of the Preferred versions contained herein.

What is claimed is:

1. An apparatus for forming a hand operated sheet turning device comprising: a stack of sheets of flexible material having a void or notch shape extending inwardly from the edge of each sheet, the void or notch shapes alternating in position with each successive sheet in the stack, comprising:

(a) a feeder mechanism for moving sheet material in a feed path, the feeder mechanism comprising:

i. first and second paper trays at opposite sides of the feed path, the first paper tray being adapted for receiving the sheet material in the form of stacked sheets, the second paper tray being adapted for sequentially receiving sheets from the feed path; and ii. means synchronized with the notch die mechanism for sequentially advancing a top sheet from the first paper tray into the feed path;

(b) a notch die mechanism comprising a die cutter, a die anvil, and means for periodically advancing the die cutter into engagement with the die anvil from opposite sides of the feed path; and (c) index means for registering a leading edge of the sheet material at alternating offset distances ahead of the notch die mechanism prior to successive operations of the notch die mechanism, the index means comprising a stop mechanism coupled to the notch die mechanism for periodically blocking leading edges of alternating sheets at different distances beyond the die cutter and die anvil of the notch die mechanism;

whereby successive sheets are formed with alternating alignment of the voids or notches therein for facilitating sequential page turning by alternating the placement of a user's finger and/or thumb on the void or notch of each successive sheet.

2. The device of claim 1 wherein the means for advancing of the feeder mechanism comprises:

(a) a suction cup mounted for reciprocal movement relative to the first paper tray between a first position proximate a top stacked sheet and a second position laterally displaced from the first paper tray and aligned with the feed path, in synchronism with the notch die mechanism; and (b) a source of intermittent vacuum synchronized with the notch die mechanism and fluid coupled to the suction cup, the vacuum being applied in the first position of the suction cup and released in the second position of the suction cup.

3. An apparatus for forming a hand operated sheet turning device comprising: a stack of sheets of flexible material having a void or notch shape extending inwardly from the edge of each sheet, the void or notch shapes alternating in position with each successive sheet in the stack, comprising:

(a) a feeder mechanism for moving sheet material in a feed path, the feeder mechanism comprising:

i. first and second paper trays at opposite extremities of the feed path, the first paper tray being adapted for receiving the sheet material in the form of stacked sheets, the second paper tray being adapted for sequentially receiving sheets from the feed path; and ii. means for sequentially advancing a top sheet from the first paper tray into the feed path;

(b) a notch die mechanism comprising a die cutter, a die anvil, and means for periodically advancing the die cutter into engagement with the die anvil from opposite sides of the feed path; and (c) index means for registering a leading edge of the sheet material at alternating offset distances ahead of the notch die mechanism prior to successive operations of the notch die mechanism, the index means comprising a control mechanism for positioning and holding successive sheets in the feed path with leading edges thereof at different predetermined distances beyond the die cutter and die anvil of the notch die mechanism prior to successive operations thereof;

whereby successive sheets are formed with alternating alignment of the voids or notches therein for facilitating sequential paoe turning by alternatina the placement of a user's finger and/or thumb on the void or notch of each successive sheet.

4. An apparatus for forming a hand operated sheet turning device, comprising a stack of sheets of flexible material having a void or notch shape extending inwardly from the edge of each sheet, the void or notch shapes alternating in position with each successive sheet in the stack, comprising:

(a) a feeder mechanism for moving sheet material in a feed path, the feeder mechanism comprising:

i. first and second paper trays at opposite sides of the feed path, the first paper tray being adapted for receiving the sheet material in the form of stacked sheets, the second paper tray being adapted for sequentially receiving sheets from the feed path; and ii. means synchronized with the notch die mechanism for sequentially advancing a top sheet from the first paper tray into the feed path;

(b) a notch die mechanism comprising a die cutter, a die anvil, and means for periodically advancing the die cutter into engagement with the die anvil from opposite sides of the feed path; and (c) index means for registering a leading edge of the sheet material at alternating offset distances ahead of the notch die mechanism prior to successive operations of the notch die mechanism, the index means comprising a stop mechanism coupled to the notch die mechanism for periodically blocking leading edges of alternating sheets at different distances beyond the die cutter and die anvil of the notch die mechanism;

whereby successive sheets are formed with alternating alignment of the voids or notches therein.

5. The device of claim 4 wherein the means for advancing of the feeder mechanism comprises:

(a) a suction cup mounted for reciprocal movement relative to the first paper tray between a first position proximate a top stacked sheet and a second position laterally displaced from the first paper tray and aligned with the feed path, in synchronism with the notch die mechanism; and (b) a source of intermittent vacuum synchronized with the notch die mechanism and fluid coupled to the suction cup, the vacuum being applied in the first position of the suction cup and released in the second position of the suction cup.

6. An apparatus for forming a hand operated sheet turning device comprising: a stack of sheets of flexible material having a void or notch shape extending inwardly from the edge of each sheet, the void or notch shapes alternating in position with each successive sheet in the stack, comprising:

(a) a feeder mechanism for moving sheet material in a feed path, the feeder mechanism comprising:

i. first and second paper trays at opposite extremities of the feed path, the first paper tray being adapted for receiving the sheet material in the form of stacked sheets, the second paper tray being adapted for sequentially receiving sheets from the feed path; and ii. means for sequentially advancing a top sheet from the first paper tray into the feed path;

(b) a notch die mechanism comprising a die cutter, a die anvil, and means for periodically advancing the die cutter into engagement with the die anvil from opposite sides of the feed path; and (c) index means for registering a leading edge of the sheet material at alternating offset distances ahead of the notch die mechanism prior to successive operations of the notch die mechanism, the index means comprising a control mechanism for positioning and holding successive sheets in the feed path with leading edges thereof at different predetermined distances beyond the die cutter and die anvil of the notch die mechanism prior to successive operations thereof;

whereby successive sheets are formed with alternating alignment of the voids or notches therein.

* * * * *

UNITED STATES PATENT AND TRADEMARK OFFICE

CERTIFICATE OF CORRECTION

PATENT NO. : 7,059,226 B2
APPLICATION NO. : 10/251520
DATED : June 13, 2006
INVENTOR(S) : Alon, Edward E.

It is certified that error appears in the above-identified patent and that said Letters Patent is hereby corrected as shown below:

| | |
|---|---|
| Col. 13, line 19 | Change "In" to – n — |
| Col. 15, line 43 | Change "352,." to – 352, -- |
| Col. 16, line 2 | Change "Preferred" to – preferred – |
| Cool. 17, line 12 | Change "paoe" to – page-- |

Signed and Sealed this

Twenty-ninth Day of August, 2006

JON W. DUDAS
*Director of the United States Patent and Trademark Office*